US006385406B1

(12) United States Patent
Funamizu et al.

(10) Patent No.: US 6,385,406 B1
(45) Date of Patent: May 7, 2002

(54) SHEET DETECTING APPARATUS WITH CORRECTION MEANS FOR SHEET SURFACE CONDITION AND SHEET THICKNESS

(75) Inventors: Yoshihiro Funamizu, Numazu; Yoshiyuki Suzuki, Yokohama; Kazuhiko Hirooka; Michiharu Masuda, both of Numazu; Masashi Oyumi, Mishima; Hajime Kaji, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/548,312

(22) Filed: Apr. 12, 2000

(30) Foreign Application Priority Data

Apr. 15, 1999 (JP) ..... 11-108247

(51) Int. Cl.[7] ..... G03G 15/00; B65H 7/02

(52) U.S. Cl. ..... 399/16; 271/265.02; 271/265.04; 399/45

(58) Field of Search ..... 399/16, 21, 23, 399/43, 45; 271/265.02, 265.04

(56) References Cited

U.S. PATENT DOCUMENTS 4,025,187 A * 5/1977 Taylor et al. ..... 399/21 X
4,503,960 A * 3/1985 Koeleman et al. ..... 399/23 X
5,153,655 A 10/1992 Suzuki et al. ..... 355/285
5,157,444 A 10/1992 Mori et al. ..... 355/282
5,187,521 A * 2/1993 Shimizu et al. ..... 399/4
5,612,776 A * 3/1997 Machino et al. ..... 399/43
5,678,127 A * 10/1997 Suga ..... 399/45
5,745,661 A 4/1998 Koh et al. ..... 395/113
5,913,099 A 6/1999 Kamei et al. ..... 399/296
6,002,906 A * 12/1999 Hino et al. ..... 399/45 X
6,070,023 A * 5/2000 Kataoka ..... 399/45

* cited by examiner

*Primary Examiner*—Fred L. Braun
(74) *Attorney, Agent, or Firm*—Fitzpatrick, Cella, Harper & Scinto

(57) ABSTRACT

There is provided a sheet detecting apparatus which detects the position of a sheet as it is conveyed through a conveying path and has reached a predetermined position. The surface condition and thickness of the sheet are also detected and a correction system is provided for correcting the position detecting result in accordance with the detected thickness and surface condition. Also provided is a conveying apparatus in which the conveyance of the sheet is controlled on the basis of the corrected sheet position detection.

18 Claims, 28 Drawing Sheets

FIG. 9B

| 0 | 0.08 | 0.3 | 0.6 | 0.7 | |
|---|---|---|---|---|---|
| ERROR | FIXED VALUE | CALCULATED VALUE | FIXED VALUE | OHP | ERROR |
| DISPLAY ERROR MESSAGE | SHEET-TO-SHEET DISTANCE 30mm | SHEET-TO-SHEET DISTANCE 20mm | SHEET-TO-SHEET DISTANCE 30mm | SHEET-TO-SHEET DISTANCE 30mm | DISPLAY ERROR MESSAGE |

FIG. 13B

| 0 | 0.08 | 0.3 | 0.6 | 0.7 |
|---|---|---|---|---|
| ERROR | FIXED VALUE | CORRECTED VALUE | FIXED VALUE | OHP | ERROR |
| DISPLAY ERROR MESSAGE | PROCESS SPEED 277mm/sec | PROCESS SPEED 416mm/sec | PROCESS SPEED 277mm/sec | PROCESS SPEED 277mm/sec | DISPLAY ERROR MESSAGE |

FIG. 22A
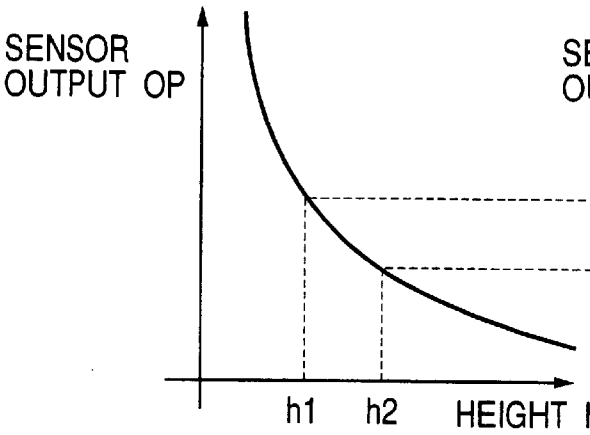
FIG. 22B
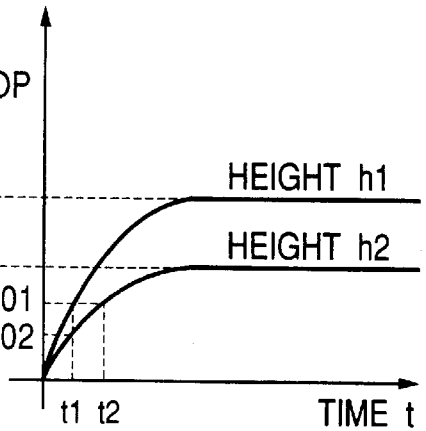
FIG. 22C
AT SENSOR OUTPUT OP=01
| HEIGHT h1 | h1 | h2 |
|---|---|---|
| TIME t | t1 | t2 |
FIG. 22D
AT TIME t=t1
| HEIGHT h1 | h1 | h2 |
|---|---|---|
| SENSOR OUTPUT OP | 01 | 02 |

FIG. 25

| THICKNESS / SURFACENESS | THIN PAPER | PLAIN PAPER | THICK PAPER |
|---|---|---|---|
| RECYCLED PAPER | t 11 | t 12 | t 13 |
| PLAIN PAPER | t 21 | t 22 | t 23 |
| GLOSSY PAPER | t 31 | t 32 | t 33 |
| OHP | t 41 | t 42 | t 43 |

SHEET DETECTING APPARATUS WITH CORRECTION MEANS FOR SHEET SURFACE CONDITION AND SHEET THICKNESS

BACKGROUND OF THE INVENTION

1. Field of the Invention

The present invention relates to a sheet detecting apparatus, a sheet conveying apparatus and an image forming apparatus to improve detecting accuracy of a sheet.

2. Related Background Art

[Background Art 1]

In the past, as a sheet sensor (sheet position detecting means) 1 used for conveyance control of a sheet S in an image forming apparatus and the like, for example, as shown in FIG. 27, a sensor constituted by a photo-interrupter 3 and a mechanical flag 2 contacted with the sheet S conveyed in a sheet conveying direction indicated by the arrow is well known.

[Background Art 2]

Further, in such a sheet sensor of contact type, although disadvantages such as chattering and time lag upon contacting of the sensor with the sheet may occur, when the conveying speed of the sheet is relatively low, since such disadvantages do not arise any problem, such a sheet sensor has been used in many apparatuses.

However, when the above-mentioned disadvantages arise serious problem or when the sheet conveying speed is high, detection of the sheet S is effected by using a sensor 4 of reflection type comprised of a light emitting element 5 and a light receiving element 6 as shown in FIG. 28.

[Background Art 3]

In an image forming apparatus such as a copying machine handling a sheet, in many cases, exclusive sheets (transfer materials) recommended by the maker of the image forming apparatus are used. However, in the present days in which various user needs exists, it has been requested that various kinds of sheets be used as transfer materials for the copying machines, other than the sheets recommended by the maker.

In the past, regarding such various sheets, the sheet has been conveyed under sheet conveyance control (for example, conveying timing upon registration and/or conveying speed) similar to the exclusive sheet. Alternatively, for example, when a thick sheet is used, in some cases, user or service man has effected the setting of the thick sheet with respect to a predetermined sheet tray through an operating portion of the copying machine to change the conveying timing.

However, in the above-mentioned background art 1, if any play is generated between the mechanical flag 2 and a shaft as a fulcrum 7 for the flag for a long term use or if an operating point is changed in dependence upon a conveying condition (for example, position along a thickness direction in a conveying path) of the sheet to be detected, error of sheet detecting accuracy of about±2 to 3 mm may occur.

In the sensor 4 of reflection type in the background art 2, depending upon the kind of the sheet, detecting error of about 1.3 mm occurred in the range of a detecting point (fully described in connection with first embodiment shown in FIG. 5).

Further, in the sensor of reflection type, detecting error due to a sheet passing position (distance between the sensor of reflection type and the sheet) may cause serious problems.

FIGS. 29A and 29B are explanatory views showing a relationship between a height direction distance with respect to the sheet (this height direction distance can be considered as deviation in the sheet thickness direction when the sheet is passed through the conveying path or as change in distance with respect to the sensor caused by the thickness of the sheet itself) and output of a sheet position detecting sensor, where FIG. 29A shows output OP of the sheet position detecting sensor with respect to the height direction distance h, and FIG. 29B shows outputs OP of the sheet position detecting sensor with respect to a passing time t when the sheet is passed through the sheet position detecting sensor with heights h1 and h2.

As shown in FIGS. 29A and 29B, for example, when it is assumed that a timing that the sheet reaches the sheet position detecting sensor corresponds to a timing that the output OP of the sheet position detecting sensor becomes 01, the arrival detection timing becomes t1 when the sheet height is h1 and becomes t2 when the sheet height is h2.

In many cases, although such detecting errors normally do not arise any serious problem, when the sheet conveying speed is requested to be further increased or when the conveying accuracy is requested to be further improved, such errors cannot be neglected.

In the above-mentioned background art 3, regarding various kinds of sheets, when the sheet is conveyed at the uniform conveying timing, since a load and a friction force acting on conveying means are differentiated depending upon the kind of sheet, poor sheet conveyance may occur.

Particularly, in a process for forming a loop in a leading end portion of the sheet at a registration portion to effect correction of skew-feed of the sheet and registration of the leading end of the sheet with an image, due to dispersion in sheet stopped positions depending upon the difference in sheet kinds, loop amounts in the sheets are differentiated, with the result that function of the registration means may be worsened and sheet jam may occur.

Further, when the user or service man effects the setting of the thick sheet with respect to the predetermined sheet tray through the operating portion of the copying machine to change the conveying timing, not only operability and workability may be worsened but also it may be difficult to cope with various sheets.

SUMMARY OF THE INVENTION

The present invention aims to eliminate the above-mentioned conventional drawbacks and an object of the present invention is to make higher accurate sheet detection possible thereby to improve reliability of stable sheet conveyance under high speed sheet conveyance and small sheet-to-sheet distance control by reducing a detecting error due to difference in sheet kind and by reducing a detecting error due to difference in sheet conveying position (distance with respect to a sensor of reflection type), when the sensor of reflection type is used as means for detecting the fact that a sheet being conveyed reaches a predetermined position.

Another object of the present invention is to improve reliability of stable sheet conveyance by making proper sheet conveyance control possible for various sheets without worsening operability and workability of users and by detecting the fact that a sheet is deviated from an allowable value permitting stable sheet conveyance and by effecting sheet conveyance control on the basis of a detecting result.

To achieve the above object, a sheet detecting apparatus according to the present invention comprises sheet position detecting means for detecting a fact that a sheet being conveyed in a conveying path reaches a predetermined position, sheet surface detecting means for detecting a surface condition of the sheet, and correction means for correcting a detection result of the sheet position detecting means in accordance with the surface condition of the sheet detected by the sheet surface detecting means.

Further, the present invention may provide a sheet detecting apparatus comprising sheet position detecting means for detecting a fact that a sheet being conveyed in a conveying path reaches a predetermined position, sheet height detecting means disposed in the vicinity of the sheet position detecting means and adapted to detect a distance between the sheet position detecting means and the sheet in a direction perpendicular to a sheet conveying plane, and correction means for correcting a detection result of the sheet position detecting means in accordance with the distance detected by the sheet height detecting means.

Further, the present invention may provide a sheet detecting apparatus comprising sheet position detecting means for detecting a fact that a sheet being conveyed in a conveying path reaches a predetermined position, sheet surface detecting means for detecting a surface condition of the sheet, sheet thickness detecting means for detecting a thickness of the sheet, and correction means for correcting a detection result of the sheet position detecting means in accordance with a detection result of the surface condition of the sheet detected by the sheet surface detecting means and the thickness of the sheet.

The sheet position detecting means includes a light emitting element for illuminating light onto the sheet being conveyed, and a light receiving element for receiving light reflected from the sheet, and, when an output value of the light receiving element for converting the received light into an electric signal exceeds a predetermined threshold level, a sheet detection signal is emitted, and the correction means preferably correct a sheet detecting timing of the sheet position detecting means.

It is preferable that timer means counted in association with the output of the sheet position detecting means is provided, and the correction means correct a set value of the timer means.

Further, it is preferable that the sheet position detecting means emit a sheet detection signal when the output value of the light receiving element for converting the received light into the electric signal exceeds the predetermined threshold level, and the correction means alters the threshold level.

Further, it is preferable that the sheet surface detecting means includes a light emitting element for illuminating light onto the sheet, polarization separation means for separating light reflected from the sheet into two polarization components, and light receiving elements for receiving the separated two polarization components respectively, and the surface condition of the sheet is detected on the basis of a calculation value obtained from output values of the two polarization components.

The calculation value may be a value obtained by dividing a difference between the two polarization components by sum of the two polarization components.

Judging means for judging as sheet judgement error if the calculation value is deviated from a predetermined range may be provided.

The sheet surface detecting means may detect reflectance with respect to the sheet.

It is preferable that the sheet surface detecting means are disposed at an upstream side of the sheet position detecting means in the conveying path.

In a sheet conveying apparatus according to the present invention, the above-mentioned sheet detecting apparatus is provided in the conveying path through which the sheet is conveyed by conveying means, and conveyance control means for controlling the conveying means on the basis of the corrected detection result of the sheet position detecting means is provided.

The conveyance control means may alter conveyance distance between the sheets given by the conveying means.

The conveyance control means may alter a sheet conveying speed of the conveying means.

The conveyance control means may effect control to alter a sheet stopping timing when the sheet is stopped by the conveying means.

It is preferable that the sheet stopping timing is a sheet stopping operation of the conveying means when a loop is formed in the sheet by abutting the leading end of the sheet against a registration member (disposed in the conveying path) by the conveying means or a conveyance starting operation for conveying the sheet from the registration member.

Further, in a sheet conveying apparatus according to the present invention, the above-mentioned sheet detecting apparatus is provided in the conveying path through which the sheet is conveyed by conveying means, and a sheet stopping timing associated with a sheet stopping operation of the conveying means or a conveyance starting operation (for conveying the sheet from the registration member) when a loop is formed in the sheet by abutting the leading end of the sheet against a registration member (disposed in the conveying path) by the conveying means is altered on the basis of the corrected detection result of the sheet position detecting means and kind and thickness of the sheet detected by the sheet surface detecting means and the sheet thickness detecting means and loop forming amount control information corresponding to pre-set kind and thickness of sheet.

The sheet stopping timing may be altered so that the loop forming amount becomes constant.

It is preferable that the sheet stopping timing associated with the sheet stopping operation of the conveying means or a conveyance starting operation (for conveying the sheet from the registration member) is altered so that the loop forming amount control information corresponding to pre-set kind and thickness of sheet becomes loop forming amount corresponding to sheets having different kind or thickness.

An image forming apparatus according to the present invention comprises the above-mentioned sheet conveying apparatus, and image forming means for forming an image on the sheet conveyed by the sheet conveying apparatus.

With this arrangement, sheet detecting accuracy can be enhanced, and the reliability of stable sheet conveyance under high speed sheet conveyance and small sheet-to-sheet distance control can be achieved.

Further, the proper sheet conveyance control for various sheets can be performed, thereby achieving the stable sheet conveyance.

BRIEF DESCRIPTION OF THE DRAWINGS

FIGS. 9A and 9B are a flowchart and a table for correction control respectively;

FIGS. 13A and 13B are a flowchart and a table for correction control for changing the threshold level respctively;

FIGS. 22A, 22B, 22C and 22D are views output of the sheet height detecting sensor and correction thereof;

FIG. 25 is a view showing correction values of a sheet stopping timing according to a fifth embodiment of the present invention;

DESCRIPTION OF THE PREFERRED EMBODIMENTS

First Embodiment

Now, a first embodiment of the present invention will be explained with reference to the accompanying drawings.

Figure 1:
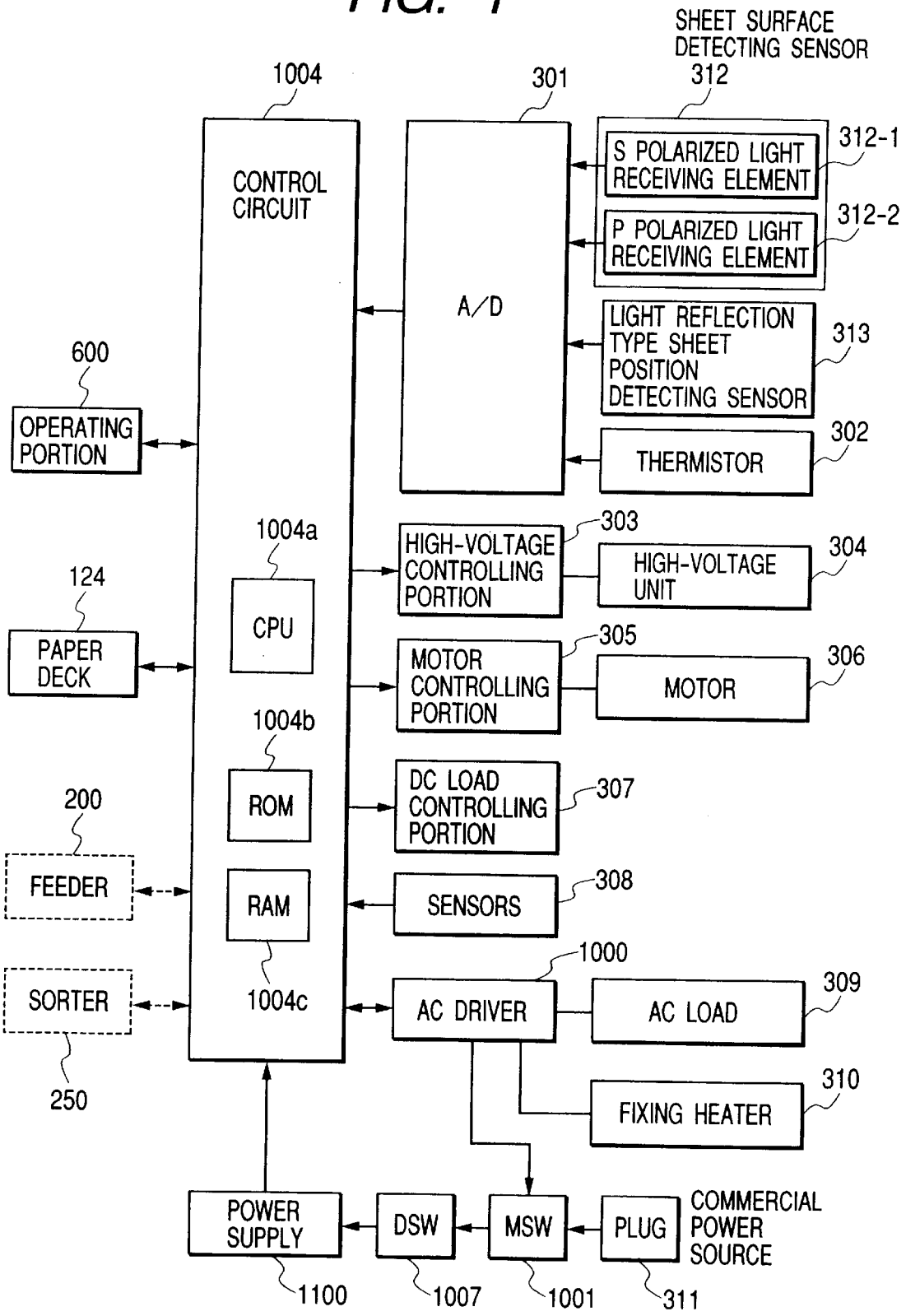
FIG. 1 is a block diagram of a control system according to a first embodiment of the present invention.

FIG. 1 is a block diagram showing an example of a control system of an image forming apparatus to which the present invention can be applied. In FIG. 1, a control circuit (controller) 1004 acting as correction means includes a CPU 1004*a*, a ROM 1004*b* and a RAM 1004*c* and serves to control a copying sequence on the basis of program stored in the ROM 1004*b*.

A thermistor 302 serves to detect a surface temperature of a fixing roller 144 (FIG. 2), and a value A/D-converted by an A/D converter 301 is inputted to the control circuit 1004. The control circuit 1004 effects control on the basis of a detection value of the thermistor 302 so that the surface temperature of the fixing roller 144 becomes a predetermined value.

A sheet surface detecting sensor 312 comprises an S-polarized light receiving element 312-1 and a P-polarized light receiving element 312-2, and a value A/D-converted by the A/D converter 301 is inputted to the control circuit 1004. The control circuit 1004 performs calculation on the basis of detection values of the S-polarized light receiving element 312-1 and the P-polarized light receiving element 312-2, thereby detecting a sheet surface, i.e., a sheet kind. Detailed explanation will be made later.

A sheet position detecting sensor 313 acts as sheet position detecting means, and a value A/D-converted by the A/D converter 301 is inputted to the control circuit 1004. The control circuit 1004 performs calculation on the basis of a detection value of the sheet position detecting sensor 313 and a correction value in accordance with the sheet kind detected by the sheet surface detecting sensor 312, thereby detecting an edge of the sheet. The correction calculation will be fully described later.

A high-voltage controlling portion 303 serves to control charging systems such as a primary charger 106 and a transfer charger 110 and a high-voltage unit 304 for applying predetermined potential to a developing device 109 and the like.

A motor controlling portion 305 serves to control driving of various stepping motors and a motor 306 such as a main drive motor.

A DC load controlling portion 307 serves to control driving of a solenoid for a pick-up roller 116, a clutch for registration rollers 120 and a fan.

Sensors 308 such as a sheet jam detecting sensor and the like are connected to the control circuit 1004. An AC driver 1000 serves to control AC load 309 such as an original illumination lamp 103 and AC power supply for a fixing heater 310. Further, it serves to detect abnormality of the original illumination lamp 103 and the fixing heater 310 and to turn off a main switch 1001 having a shut-off function.

A power supply 1100 serves to supply DC power source to the control circuit 1004, and commercial power source is inputted from an input power supply plug 311 to the power supply 1100 through the main switch 1001 and a door switch 1007.

A paper deck 124 is a sheet feeding device for increasing the number of stacked sheets, a feeder 200 is an auto original feeder for automatically setting a plurality of originals, and a sorter 250 is a sorting device for sorting discharged sheets.

An operating portion 600 includes a touch panel 703, an LCD 701 and a back light 702 and is connected to the control circuit 1004.

Figure 2:
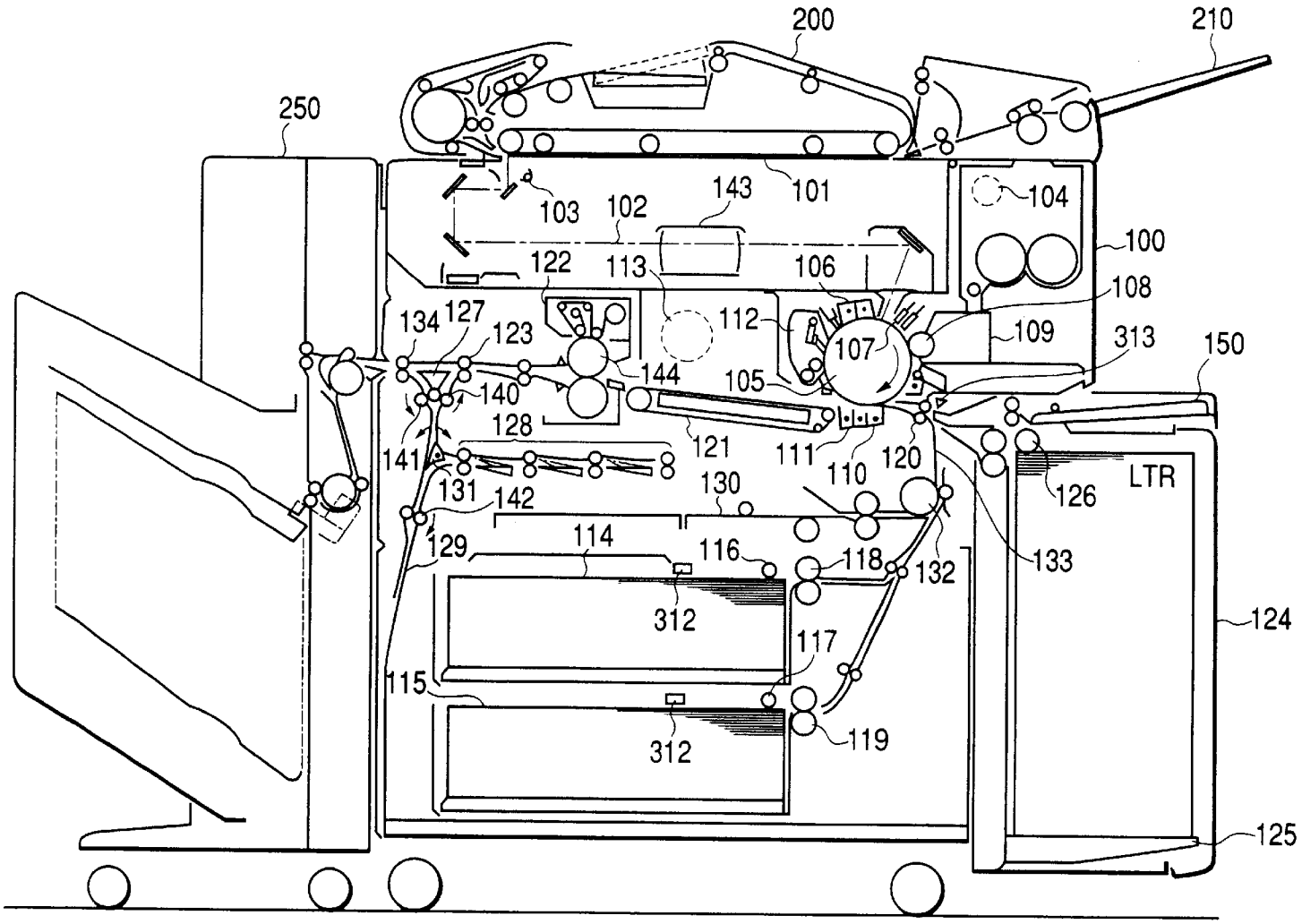
FIG. 2 is a sectional view of an image forming apparatus.

FIG. 2 is a sectional view showing an example of an image forming apparatus according to the present invention. In FIG. 2, the circulating automatic original feeding device or feeder (referred to an "RDF" hereinafter) 200 for automatically feeding the originals and the sorting device or sorter 250 are detachably combined with a main body 100 of the image forming apparatus.

In FIG. 2, the image forming apparatus comprises an original glass stand (original stocking plate) 101, and an optical system (image reading means) 102 including an exposure lamp 103 for illuminating the original, a scanning mirror, a lens 143 and a motor 104. The original is illuminated by the exposure lamp 103 while effecting the scanning by the motor 104, and light reflected from the original is illuminated onto a photosensitive drum 105 through the scanning mirror and the lens 143.

Around the photosensitive drum 105, there are disposed a primary charger 106, a blank exposure unit 107, a potential sensor 108, a developing device 109, a transfer charger 110, a separating charger 111, and a cleaning device 112. All of these elements including the photosensitive drum 105 constitute image recording means.

The photosensitive drum 105 is rotated in a direction indicated by the arrow in FIG. 2 by means of a main motor 113 and is corona-charged by the primary charger 106. When the light reflected from the original in the optical system 102 is illuminated on the photosensitive drum, an electrostatic latent image is formed on the drum. The electrostatic latent image is developed by the developing device 109 to be visualized as a toner image.

On the other hand, after a leading end of the sheet fed from an upper cassette 114 or a lower cassette 115 by a sheet feed roller 118 or 119 via a pick-up roller 116 or 117 to the main body 100 is aligned with a leading end of the toner image by the registration rollers 120, the sheet is fed to the photosensitive drum 105. Then, the toner image is transferred onto the sheet by the transfer charger 110.

After the transferring, the sheet is separated from the photosensitive drum 105 by the separating charger 111, and the separated sheet is directed, by a conveying belt 121, to a fixing device 122, where the toner image is fixed to the sheet by heat and pressure. Thereafter, the sheet is discharged out of the main body 100 by a pair of discharge rollers 123. On the other hand, the surface of the photosensitive drum 105 is cleaned by the cleaning device 112.

Within the main body 100, there is provided a paper deck 124 capable of containing four thousands (4000) sheets, for example. A lifter 125 of the paper deck 124 is lifted in accordance with the amount of the sheets so that an uppermost sheet always abuts against the sheet feeding roller 126. Further, a multi-manual feed tray 150 through which the operator can perform manual sheet feed is disposed above the paper deck 124.

Further, in FIG. 2, a sheet discharge flapper 127 serves to switch between a path for both-sided recording or multi-recording and a path for sheet discharge (sorter 250). The sheet discharged from the pair of discharge rollers 123 is switched toward the path for both-sided recording or multi-recording by the sheet discharge flapper 127. A lower conveying path 128 serves to turn over the sheet discharged from the pair of discharge rollers 123 through a surface reversing path 129 and to direct the sheet to a re-feed tray 130.

A multi flapper 131 serves to switch between the path for both-sided recording and the path for multi-recording, and, by inclining the flapper toward the left, the sheet is directly directed to the lower conveying path 128 without passing through the surface reversing path 129.

A sheet feeding roller 132 serves to feed the sheet toward the photosensitive drum 105 through a path 133. A pair of discharge rollers 134 are disposed in the vicinity of the sheet discharge flapper 127 and serves to discharge the sheet switched toward the discharge side by the sheet discharge flapper 127 out of the image forming apparatus.

In the both-sided recording (both-sided copying) and the multi-recording (multi-copying), the sheet discharge flapper 127 is lifted, so that the copied sheet is contained in the re-feed tray 130 through the lower conveying path 128 and the surface reversing path 129 in a state that the surfaces of the sheet are reversed or turned over.

In this case, in the both-sided recording, the multi flapper 131 is inclined to the right, and, in the multi-recording, the multi flapper 131 is inclined to the left. In the next both-sided recording and the multi-recording, the sheets contained in the re-feed tray 130 are directed one by one from a lowermost sheet to the pair of registration rollers 120 of the main body by the sheet feeding roller 132 through the path 133.

When the sheet is discharged from the main body while being turned over, the sheet discharge flapper 127 is lifted and the multi flapper 131 is inclined to the right, so that the copied sheet is conveyed to the surface reversing path 129, and, after a trailing end of the sheet passes through a first feed roller 140, the sheet is conveyed toward a second feed roller 141 by a reversing roller 142 and is discharged out of the image forming apparatus while being turned over by the pair of discharge rollers 134. Incidentally, the sheet conveying paths include a plurality of sensors (not shown) which perform sheet jam detection such as detection (delay jam detection) for detecting the fact that the sheet does not reach till a predetermined timing and detection (trap jam detection) for detecting the fact that the sheet does not leave the sensor till a predetermined timing. If the sheet jam is detected, after a predetermined operation, the apparatus is stopped and predetermined sheet jam display is effected.

The sheet surface detecting sensor 312 includes the S-polarized light receiving element and the P-polarized light receiving element, as will be described later. On the basis of detection value of the S-polarized light receiving element and the P-polarized light receiving element, calculation is effected, thereby detecting the sheet kind through sheet surface detection.

The detection value of the sheet position detecting sensor 313 is corrected on the basis of the sheet kind detected by the sheet surface detecting sensor 312, thereby detecting the leading end of the sheet.

Figure 3:
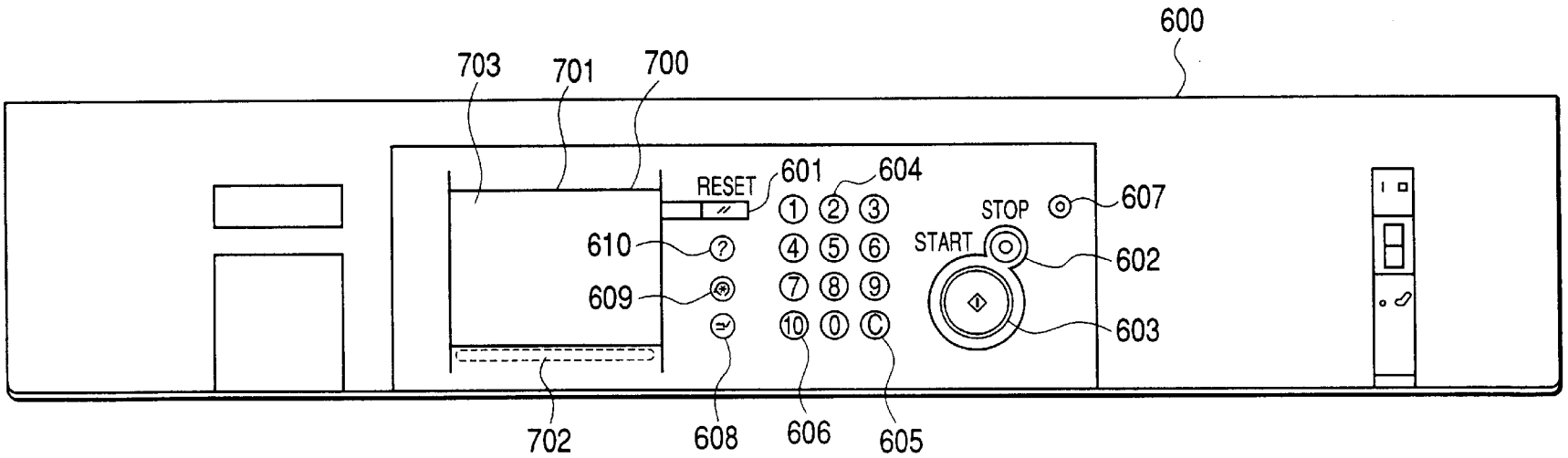
FIG. 3 is a view showing an arrangement of an operating portion.

FIG. 3 shows an arrangement of an operating portion 600 provided on the main body 100.

In FIG. 3, the operating portion includes a reset key 601 used when a copy mode is selected to a standard mode, a stop key 602 used when the copying is interrupted or stopped, a start key 603 used when the copying is started, a ten-key 604 used for setting the number of copies and inputting numerical value, and a clear key 605 used when the copy number is selected to one (1) sheet and when the numerical value inputted from the ten-key is cleared.

A personal identification number key 606 is used when a personal identification number mode is set. A pre-heating key 607 is used when a pre-heating mode is set and cleared. In the setting of the pre-heating mode, the temperature of the fixing device can be lowered to reduce the power consumption. An interruption key 608 is used when interruption copy is effected. A user mode key 609 is used when a user mode (such as setting of specification and timer setting) is set and cleared. A guide key 610 is used when explanation of modes is displayed.

The message display 700 includes the LCD 701 comprised of a transmission type LCD (liquid crystal display) unit of 320×240 dots, and the back light 702 comprised of a cold cathode tube, and a touch panel 703 having key matrix of 15×20 is arranged on the surface of the display, so that display of various modes, display of various conditions and key display corresponding to the key input from the touch panel are effected.

Figure 4A:
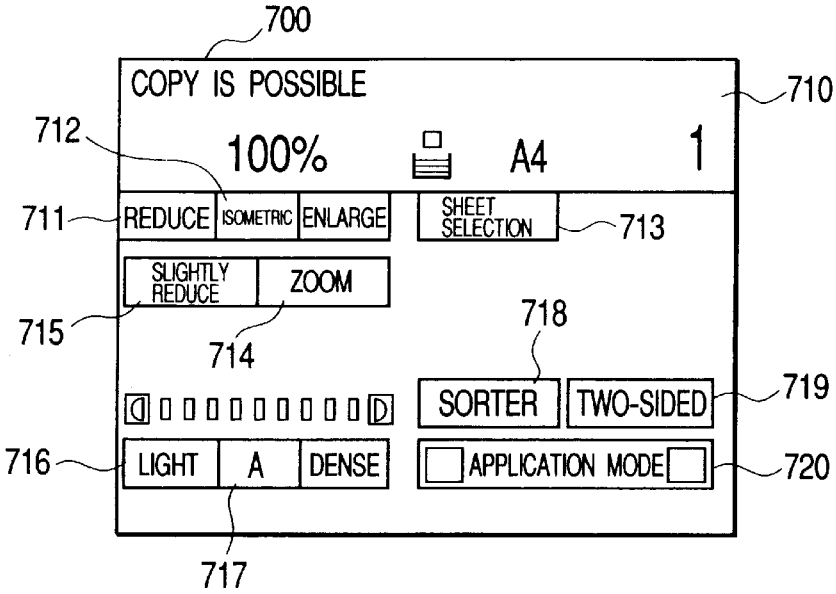
FIGS. 4A, 4B and 4C are views showing message displays.
Figure 4B:
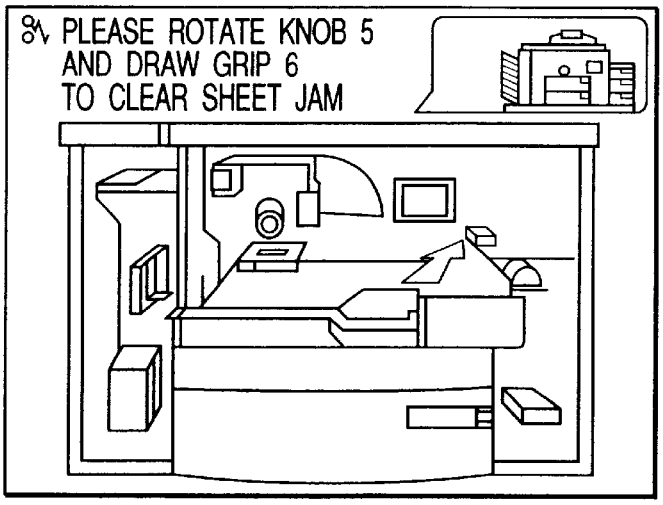
Figure 4C:
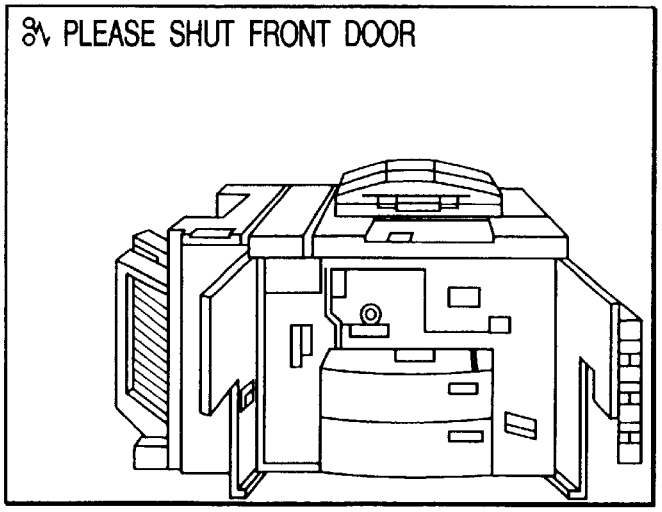

FIGS. 4A, 4B and 4C show displays and key arrangements of the message display 700, where FIG. 4A shows a standard picture plane, FIG. 4B shows a jam clearance picture plane, and FIG. 4C shows a picture plane instructing "close door after jam clearance".

In FIG. 4A, a displaying portion 710 serves to display magnification, sheet feeding cassette selection and copy number. A reduction/enlargement key 711 is used when reduction or enlargement is desired. An isometric key 712 is used when the magnification is returned to isometric (100%). A sheet selection key 713 is used when an auto sheet selection, an upper cassette 114, a lower cassette 115, a paper deck 124 or a multi-manual feed 150 is selected.

A zoom key 714 is used when a zoom mode is set. A slightly reduction key 715 is used when the image of the original is copied with slight reduction (for example, 93%). A copy density key 716 is used when copy density is adjusted manually. An AE key 717 is used when an AE (auto density adjustment) is set and cleared.

A sorter key 718 is used when a sort mode, a staple sort mode or a group mode is selected. A two-sided copying key 719 is used when a two-sided copying mode is set and cleared. An application mode key 720 is used when application modes which are not indicated in the standard picture plane are selected.

With the above-mentioned arrangement, in the image forming apparatus according to the first embodiment shown by the block diagram of FIG. 1, high accurate sheet leading end detection and correction control will be explained hereinbelow.

The CPU 1004*a* serves to effect correction control, the ROM 1004*b* stores contents of control, and the RAM 1004*c* serves to read and write the data. The reference numeral 312-1 denotes an S-polarized light receiving element: 312-2 denotes a P-polarized light receiving element; 313 denotes a sheet position detecting sensor; and 301 denotes an A/D converter.

With the arrangement as mentioned above, the correction control in which the kind of the sheet is judged by the sheet surface detecting sensor 312 and output of the sheet position detecting sensor 313 is corrected on the basis of the detected kind of sheet will be described hereinbelow.

First of all, the sheet position detecting sensor 313 connected to the A/D converter will be explained. The sheet position detecting sensor 313 explained here detects a leading end of a moving object to be detected. However, if reflectance of the surface of the moving object differs, a detecting point will also differ in principle, for example, due to difference in kind of sheet.

Figure 5A:
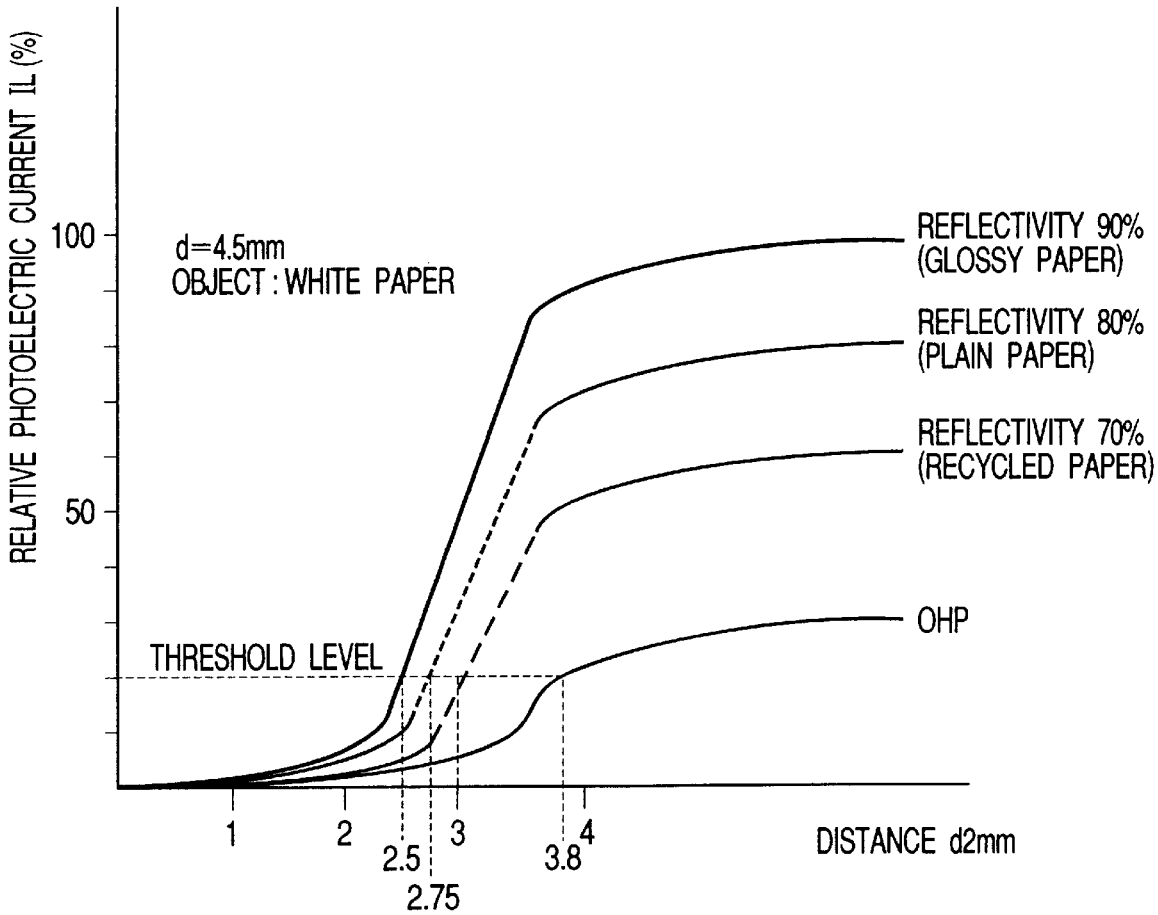
FIGS. 5A and 5B are views showing a property of a sheet position detecting sensor.
Figure 5B:
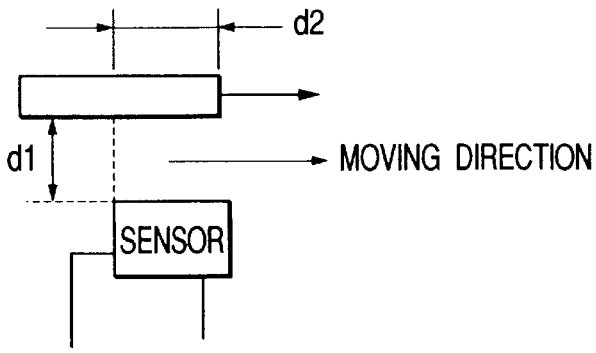

FIGS. 5A and 5B show property (difference in detecting point due to difference in reflectance) of the sheet position detecting sensor 313. In the graph, the abscissa indicates a distance between a leading end of a moving object to be detected and an end of the sheet position detecting sensor 313, i.e., a distance from which the sheet position detecting sensor 313 starts to detect the object. The ordinate indicates output value of the sheet surface detecting sensor 312, i.e., relative photoelectric current IL (%) which is obtained by converting light (illuminated from the light emitting element of the sheet position detecting element 313) reflected from the object to be detected and received by the light receiving element into an electric signal as an electric current value.

Further, in the graph, the relative photoelectric current IL (%) indicated by the ordinate is relative photoelectric current when detection level of an object having reflectance of 100% is 100%.

As can be seen from the graph, in a threshold level of 20%, when a glossy paper having reflectance of 90% advances from the end (front side of the sensor in the sheet feeding direction) of the sheet position detecting sensor 313 by 2.5 mm, the sheet detecting point is reached.

Similarly, in the threshold level of 20%, when a plain paper having reflectance of 80% advances from the end (front side of the sensor in the sheet feeding direction) of the sheet position detecting sensor 313 by 2.75 mm, the sheet detecting point is reached.

In the threshold level of 20%, when a recycled paper having reflectance of 70% advances from the end (front side of the sensor in the sheet feeding direction) of the sheet position detecting sensor 313 by 3 mm, the sheet detecting point is reached.

In the threshold level of 20%, when an OHP sheet advances from the end (front side of the sensor in the sheet feeding direction) of the sheet position detecting sensor 313 by 3.8 mm, the sheet detecting point is reached.

Next, the sheet surface detecting sensor 312 shown in FIG. 6 will be explained.

First of all, the detecting principle will be described with reference to the accompanying drawings. Light is incident on the sheet (object to be detected) at a predetermined incident angle. In this case, the reflectances of the P-polarized component and the S-polarized component differ from each other in dependence upon the difference in surface condition of the object to be detected. By comparing a ratio between light amounts of the P-polarized component and the S-polarized component of the reflected light by utilizing such difference in reflectance, the kind of the sheet (object to be detected) is judged.

The sheet surface detecting sensor comprises an S-polarized light receiving element 312-1, a P-polarized light receiving element 312-2, a polarizing beam splitter 312-3 for dividing the polarized light components of light, and a light emitting element (LED) 312-4.

Figure 6:
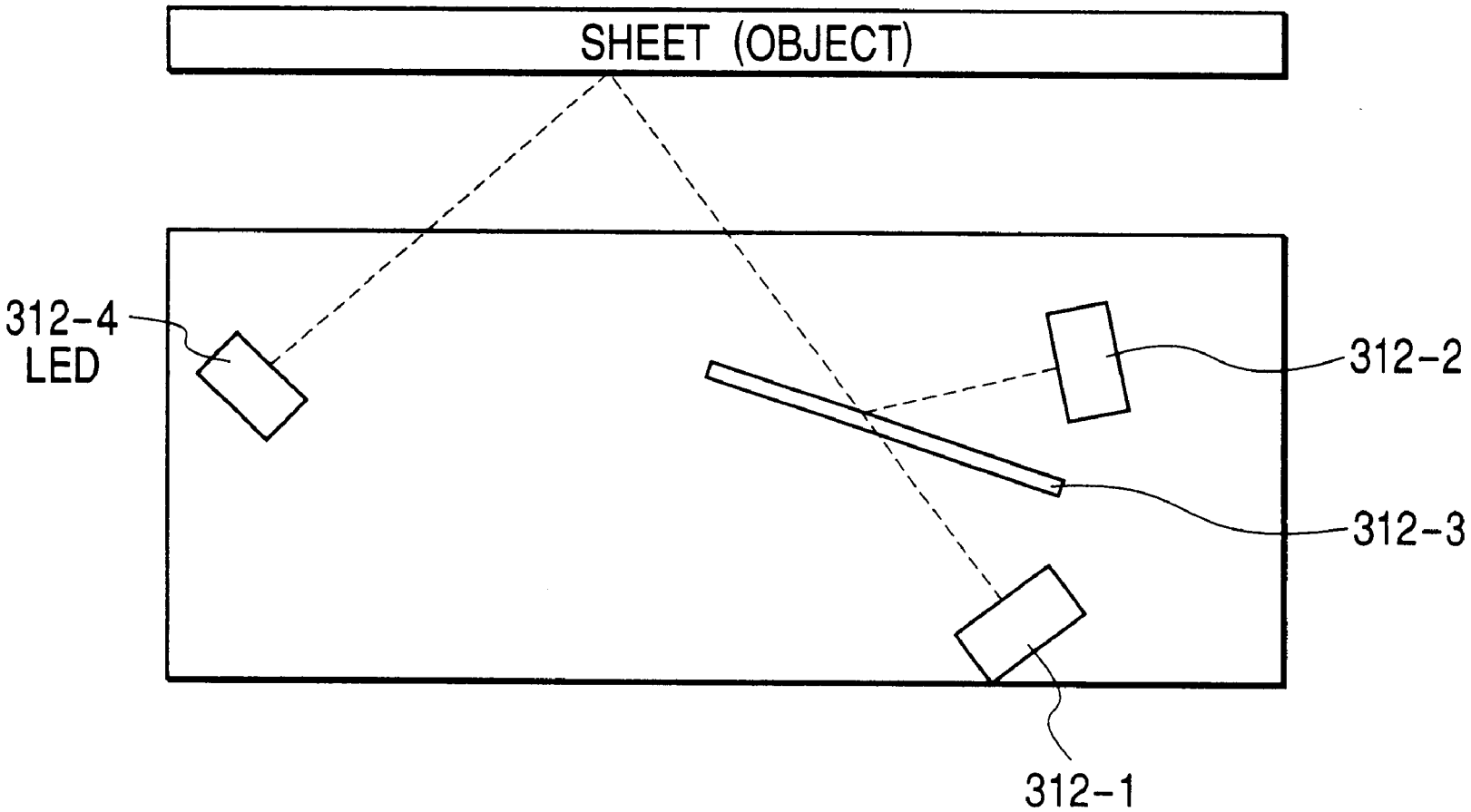
FIG. 6 is a view showing a sheet surface detecting sensor.

With the arrangement shown in FIG. 6, sum/difference of the output signal PD2 of the S-polarized light receiving element 312-1 and the output signal PD1 of the P-polarized light receiving element 312-2 is calculated as an output calculation value Px of the sheet surface detecting sensor from the following equation:

$$Px=(PD2-PD1)/(PD2+PD1)$$

Figure 7A:
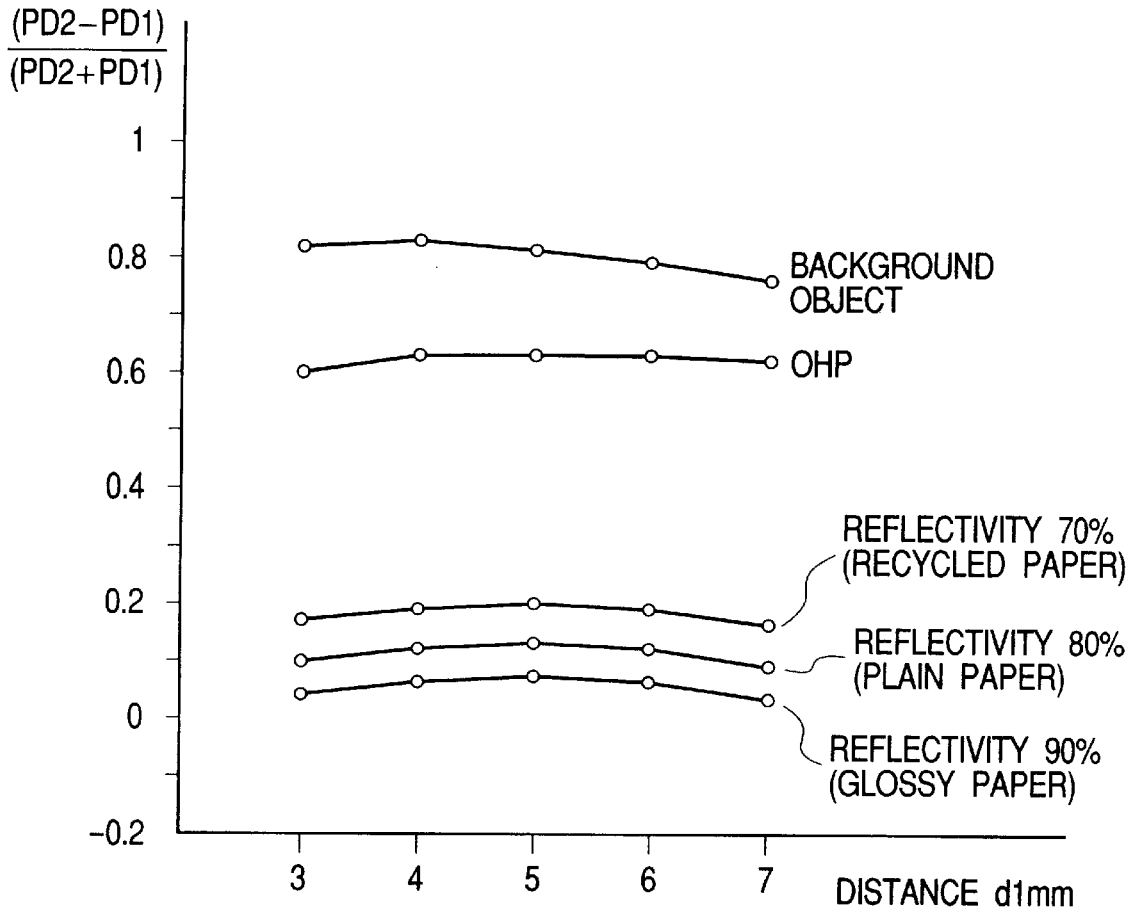
FIGS. 7A and 7B are views showing an output calculation result of the sheet surface detecting sensor.
Figure 7B:
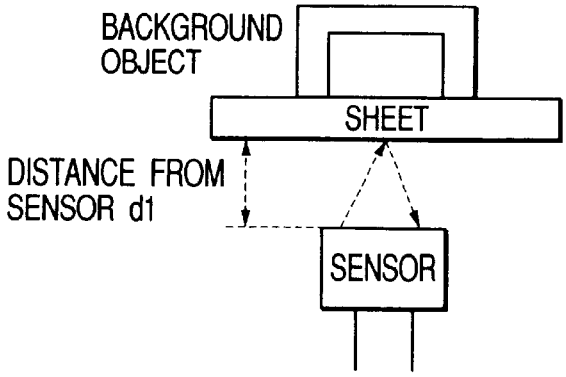

Calculation results from the above equation are shown in FIGS. 7A and 7B.

In FIG. 7A, the abscissa indicates a distance from the sensor. The ordinate indicates a value calculated on the basis of the above equation. As can be seen from FIG. 7A, when the distance between the sheet (object to be detected) and the sheet surface detecting sensor 312 is 5 mm (central value), the glossy paper (sheet) having reflectance of 90% has a value of 0.06, the plain paper (sheet) having reflectance of 80% has a value of 0.14, the recycled paper (sheet) having reflectance of 70% has a value of 0.22, and the OHP sheet has a value of 0.63.

Figure 8:
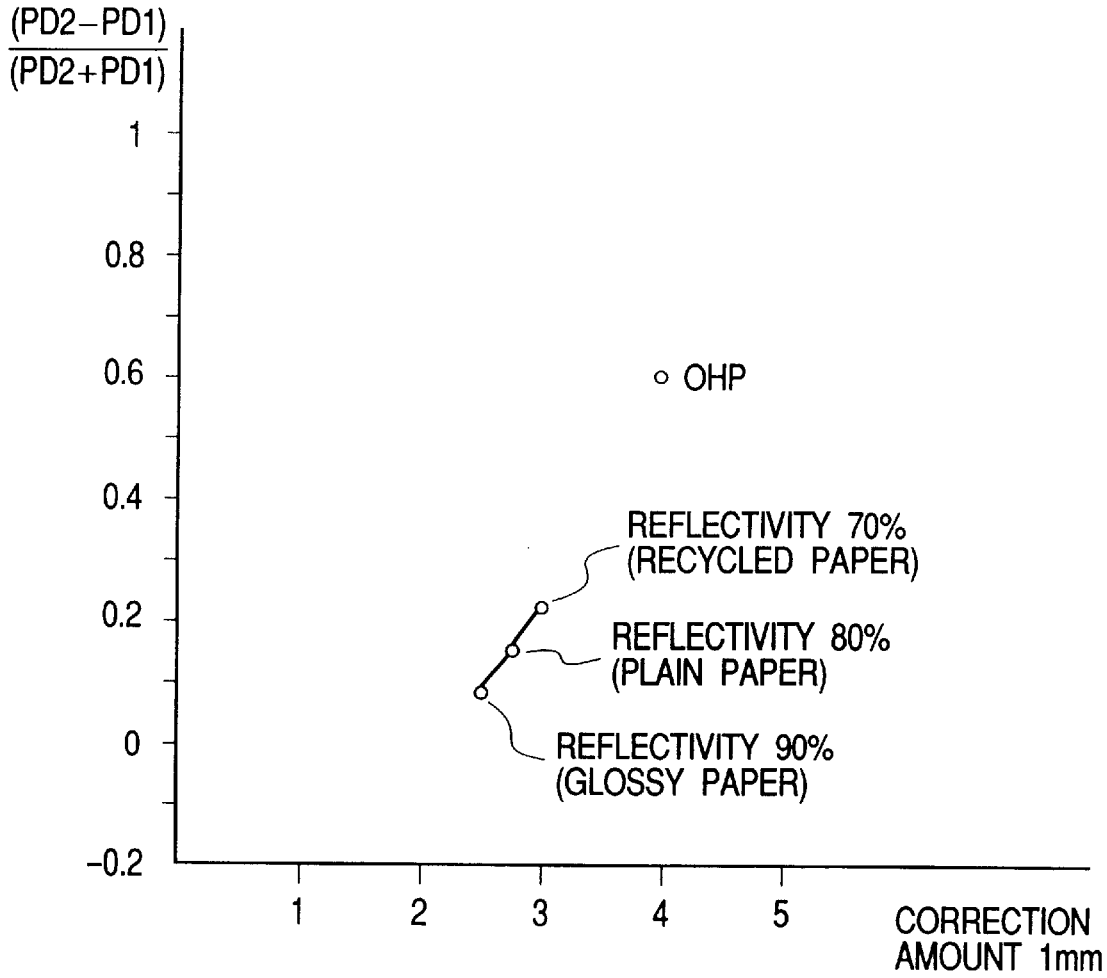
FIG. 8 is a view for explaining correction values corresponding to kinds of sheets.

FIG. 8 shows a relationship between the kinds of sheet detected by the sheet surface detecting sensor 312 and the correction amounts for correcting the difference in detecting point (distance) of the sheet position detecting sensor 313.

Figure 9A:
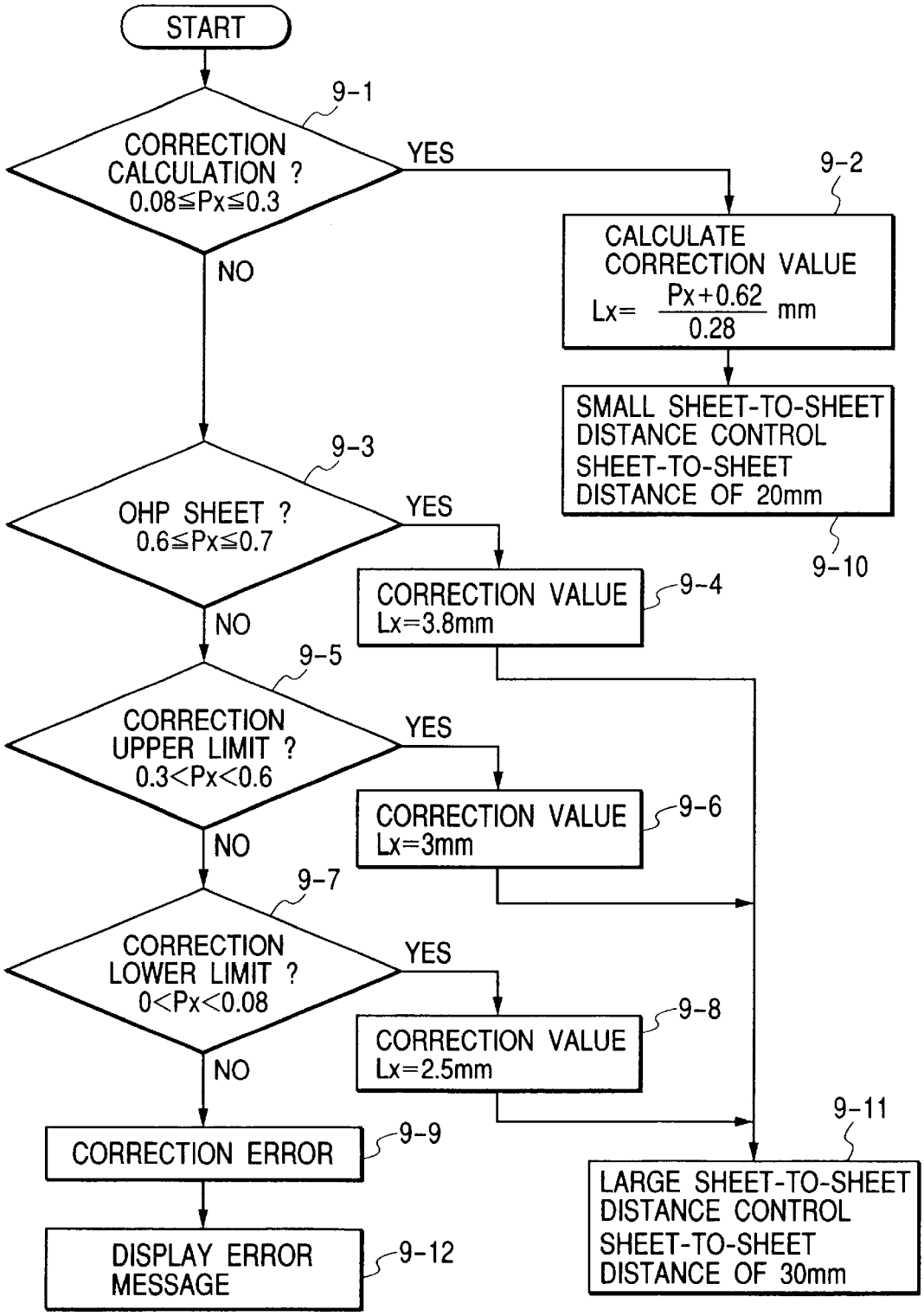

Calculation or judgement of the correction value based on the kind of sheet shown in FIG. 8 will be explained with reference to FIG. 9A (flowchart) and FIG. 9B (table).

First of all, it is judged whether or not there is a correction calculation area (step 9-1). If the correction calculation area, a correction value Lx is calculated on the basis of the following equation (step 9-2). However, Px is defined by the above-mentioned equation (Px=(PD2−PD1)/(PD2+PD1)):

Correction value Lx=(Px+0.62)/0.28 (mm)

In this correction calculation area, since the detecting accuracy of the sheet position detecting sensor 313 is high, small sheet-to-sheet distance control is effected to control so that a sheet-to-sheet distance becomes 20 mm (step 9-10).

Then, it is judged whether or not the sheet is an OHP sheet (step 9-3). Regarding the judgement for the OHP sheet, if the output calculation value Px of the sheet surface detecting sensor 312 is $0.6 \leqq Px \leqq 0.7$, it is judged as the OHP sheet, and the correction is effected with the correction value of 3.8 mm (fixed value).

If it is judged as the OHP sheet, since the detecting accuracy of the sheet position detecting sensor 313 is low, great sheet-to-sheet distance control is effected to control so that a sheet-to-sheet distance becomes 30 mm (step 9-10).

Further, if the output calculation value Px of the sheet surface detecting sensor 312 is $0.3<Px<0.6$, it is judged as an upper limit fixed value (step 9-5), and the correction value when the output calculation value Px of the sheet surface detecting sensor 312 is 0.3 (i.e., 3 mm) is used as the fixed value (step 9-6).

If it is judged as the correction fixed value area, since the detecting accuracy of the sheet position detecting sensor 313 is low, great sheet-to-sheet distance control is effected to control so that a sheet-to-sheet distance becomes 30 mm (step 9-10).

If the output calculation value Px of the sheet surface detecting sensor 312 is $0<Px<0.08$, it is judged as a correction lower limit fixed value area (step 9-7), and the correction value when the output calculation value Px of the sheet surface detecting sensor 312 is 0.08 (i.e., 2.5 mm) is used as the fixed value (step 9-8). If it is judged as this correction fixed value area, since the detecting accuracy of the sheet position detecting sensor 313 is low, great sheet-to-sheet distance control is effected to control so that a sheet-to-sheet distance becomes 30 mm (step 9-10).

Further, if the output calcuation value Px of the sheet surface detecting sensor 312 is $0.7<Px$ or $Px \leqq 0$, since the judgement of the kind of sheet is impossible, it is judged as correction error (step 9-9). Further, since the sheet exceeds a design allowable value, a message "sheet judgement error" is displayed on the display 700 of the operating portion 600 (step 9-12).

Figure 10:
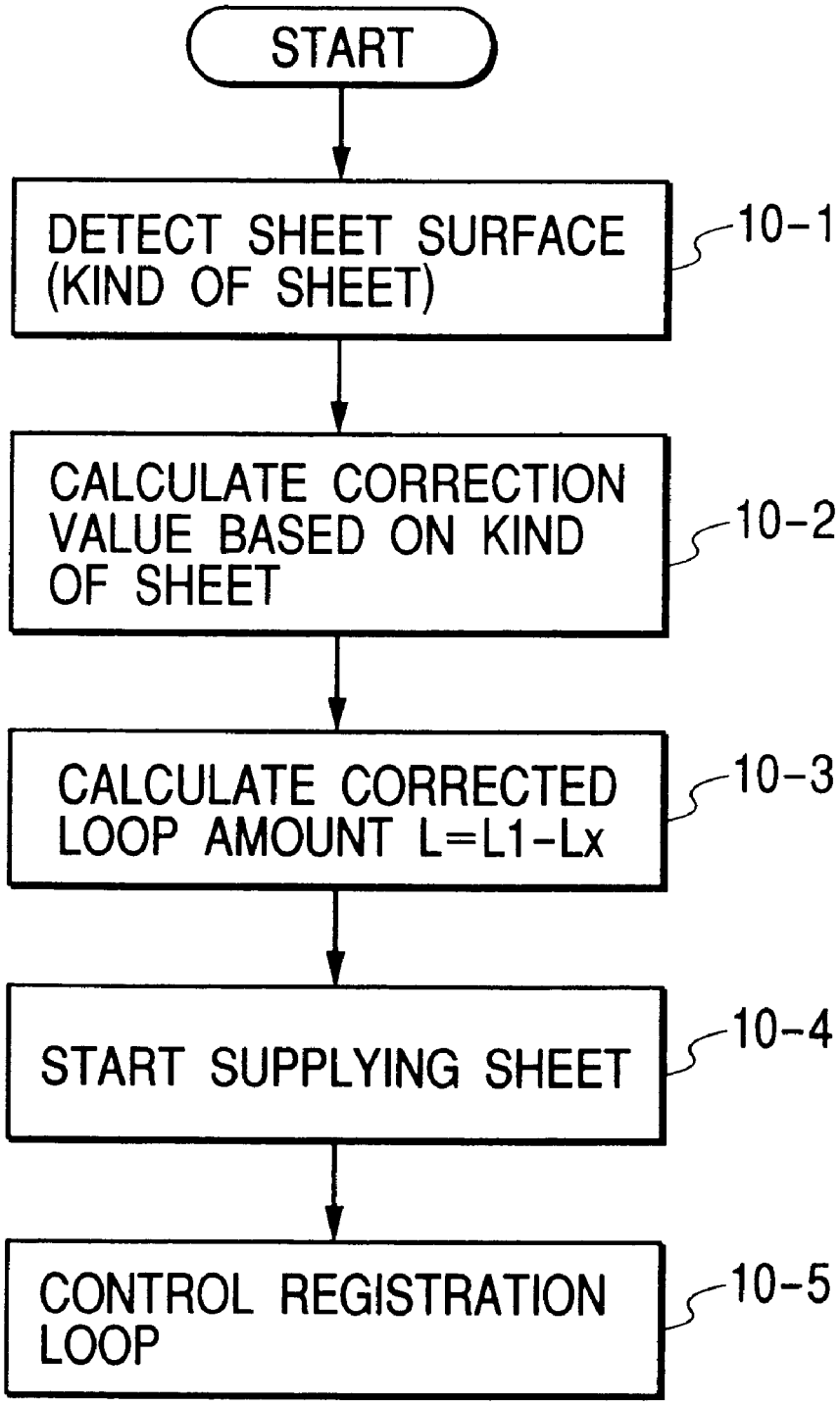
FIG. 10 is a flowchart for correction control of a registration loop amount.

Next, a flowchart for effecting correction of a registration loop amount when sheet leading end registration is controlled based on the kind of sheet for each sheet supplying will be explained with reference to FIG. 10. The sheet leading end registration explained hereinbelow means control in which a leading end of the sheet is aligned with an image leading end of the latent image on the surface of the photosensitive drum 105.

Further, the registration loop amount means a loop amount required in the control in which the sheet is once abutted against the stopped registration rollers 120 and is then intactly conveyed to form a loop in the sheet to correct skew-feed of the sheet and the image leading end of the latent image on the photosensitive drum 105 is aligned with the leading end of the sheet by rotating (turning ON) the registration rollers 120 at a predetermined timing.

In the actual operation, a copy job is started by depressing a copy button of the operating portion to detect a surface of a sheet (step 10-1). The above-mentioned sheet kind correction value is calculated (step 10-2) and the predetermined loop amount L1 is corrected on the basis of the kind of the sheet.

For example, when the registration loop amount is 10 mm, the correction amount of the glossy paper (sheet) having reflectance of 90% is 2.5 mm. That is to say, a position that advances from the end (front side of the sensor in the sheet feeding direction) of the sheet position detecting sensor 313 by 2.5 mm becomes the detecting point.

Thus, when the correction loop amount L (=L1−Lx) is calculated by subtracting the correction value of 2.5 mm read by the sheet position detecting sensor 313 from the pre-determined loop amount of 10 mm, a loop amount after correction becomes 7.5 mm.

Similarly, the correction amount Lx of the plain paper is 2.75 mm. Thus, when the correction loop amount L (=L1−Lx) is calculated, a loop amount after correction becomes 7.25 mm. After the loop amount correction calculation, the sheet supplying is started (step 10-4), and the above-mentioned sheet leading end registration is controlled (step 10-5).

[Second Embodiment]

Now, a second embodiment of the present invention will be explained with reference to the accompanying drawings. In the first embodiment, while an example that the sheet detecting point (distance) of the sheet position detecting sensor 313 is corrected on the basis of the kind of sheet was explained, in the second embodiment, the correction is effected by changing a sheet detecting threshold level of the sheet position detecting sensor 313 on the basis of the kind of the sheet.

Figure 11A:
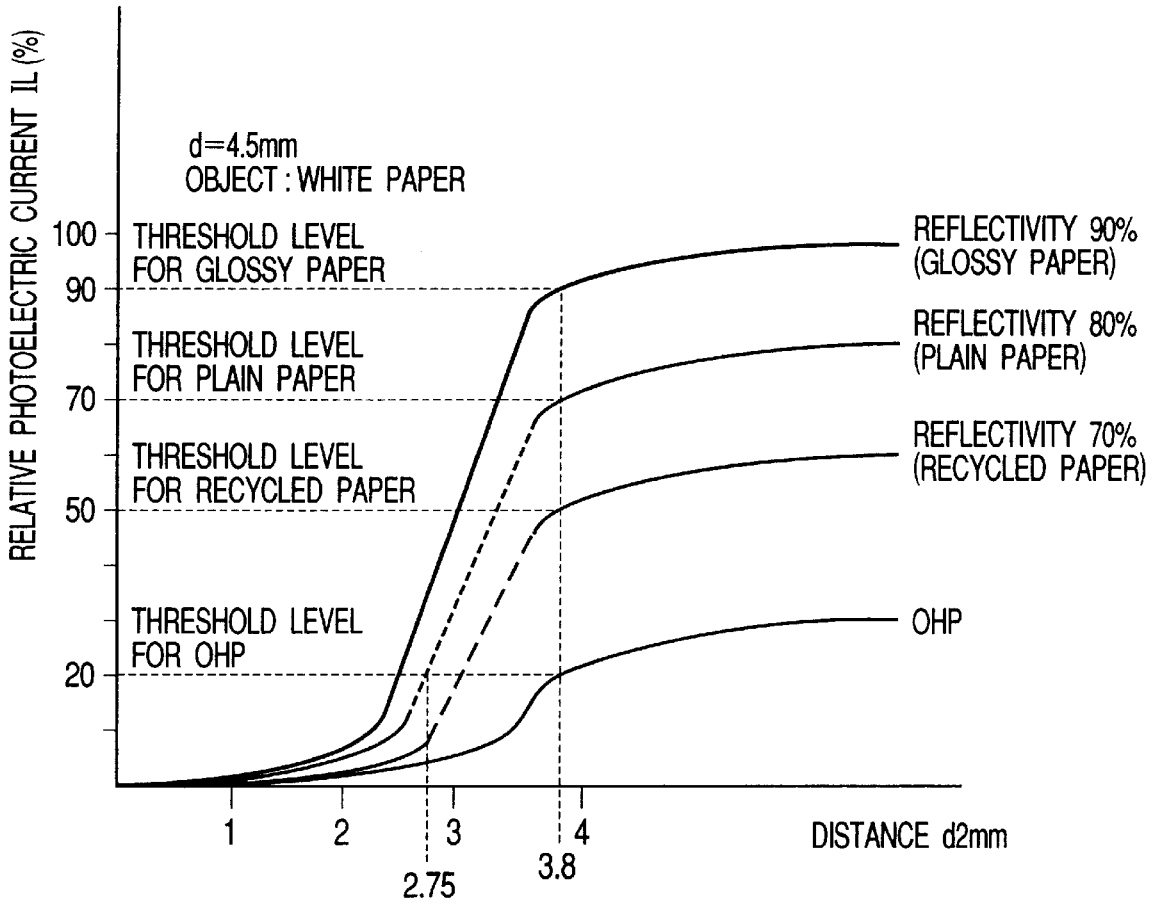
FIGS. 11A and 11B are views showing a property of a sheet position detecting sensor.
Figure 11B:
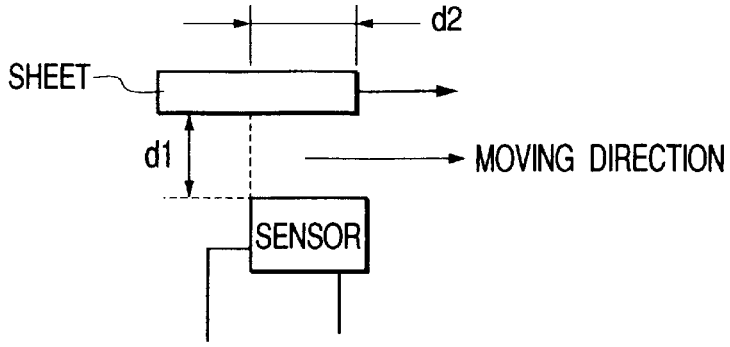

FIGS. 11A and 11B show property (difference in detecting point due to difference in reflectance) of the sheet position detecting sensor 313. In the graph, the abscissa indicates a distance between a leading end of a sheet (a moving object to be detected) and an end of the sensor, i.e., a distance from which the sensor starts to detect the object. The ordinate indicates output value of the sensor, i.e., relative photoelectric current IL (%) which is obtained by converting light (illuminated from the light emitting element of the sheet position detecting element 313) reflected from the sheet (object to be detected) and received by the light receiving element into an electric signal as a current value. Further, in the graph, the relative photoelectric current IL (%) indicated by the ordinate is relative photoelectric current when detection level of an object having reflectance of 100% is 100%.

As can be seen from the graph, in a threshold level of 20%, when the OHP sheet (object to be detected) advances from the end (front side of the sensor in the sheet feeding direction) of the sheet position detecting sensor 313 by 3.8 mm, the sheet detecting point is reached.

Regarding the glossy paper having reflectance of 90%, a threshold level is selected to 90% to have the same detecting point as that of the OHP sheet. Similarly, the threshold level of the plain paper having reflectance of 80% is selected to 70% and the threshold level of the recycled paper having reflectance of 70% is selected to 50%.

In accordance with FIG. 7A explained in connection with the first embodiment, the kind of the sheet is judged from the output of the sheet surface detecting sensor 312 and the detection value of the sheet position detecting sensor 313 is corrected on the basis of the detected kind of the sheet. Now, the correction control will be described.

Figure 12:
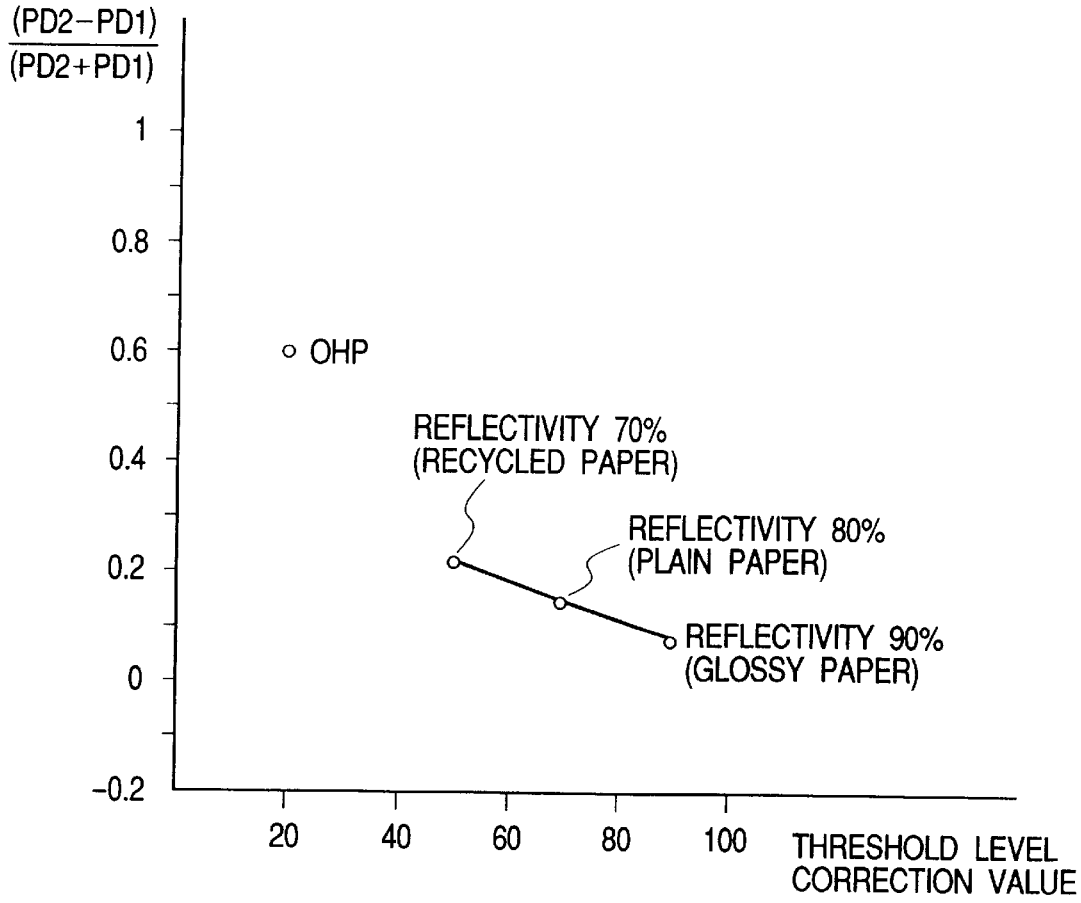
FIG. 12 is a view for explaining threshold levels.

FIG. 12 is a graph showing a relationship between the threshold level and the output calculation value of the sheet surface detecting sensor when the kind of the sheet is judged by the sheet surface detecting sensor 312 and the threshold level is changed in accordance with the detected kind of the sheet so that the detecting point of the sheet position detecting sensor 313 becomes the same regardless of the kind of the sheet.

Figure 13A:
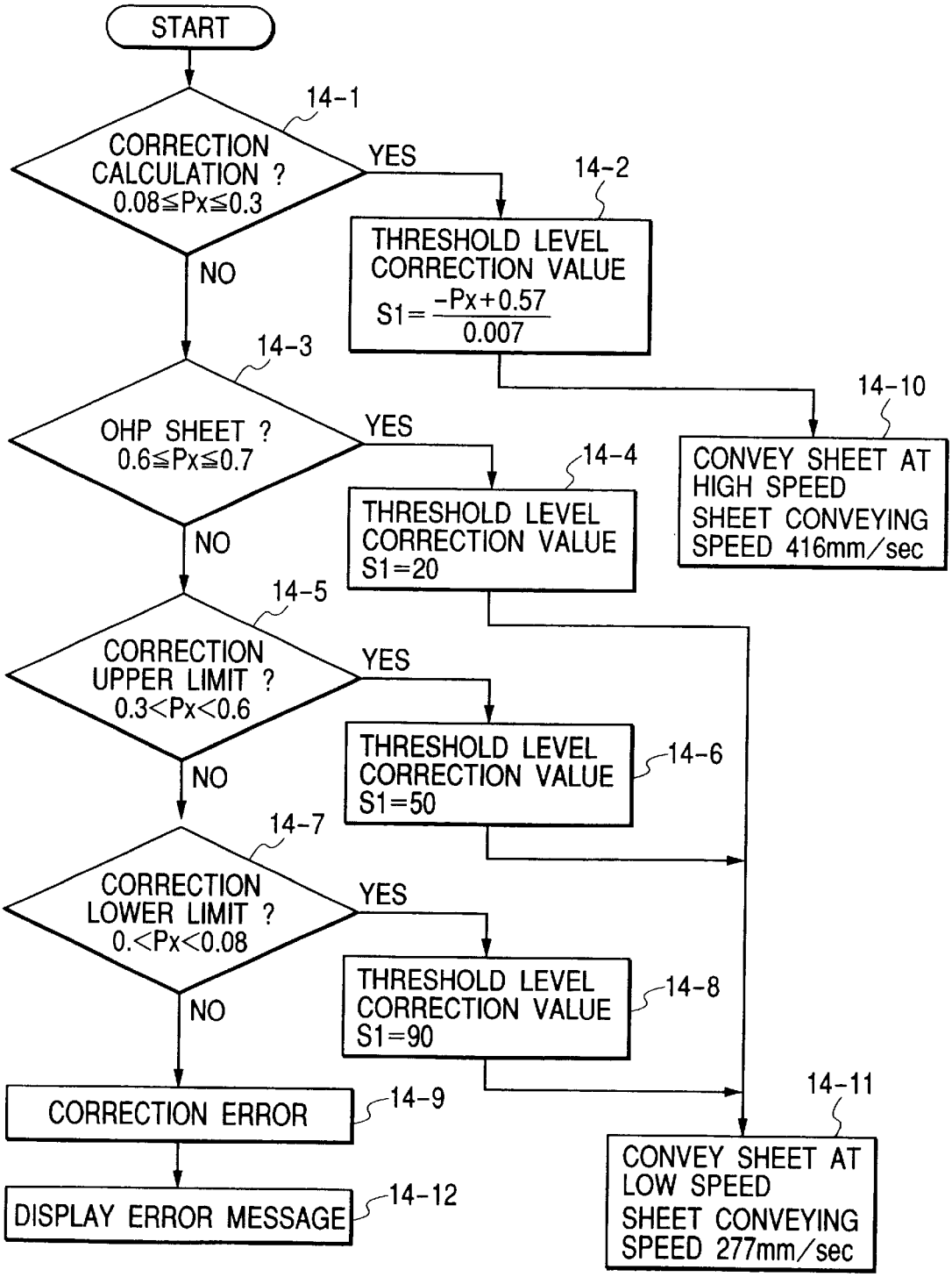

On the basis of this relationship, the correction control effected by changing the threshold level based on the kind of the sheet will be explained with reference to FIG. 13A (flowchart) and FIG. 13B (table).

First of all, it is judged whether or not there is a correction calculation area (step 14-1). If the correction calculation area, a correction value S1 is calculated on the basis of the following equation (step 14-2). However, Px is defined by the above-mentioned equation (Px=(PD2−PD1)/(PD2+PD1)):

Threshold level correction value

S1=(−Px+0.57)/0.007

In this correction calculation area, since the detecting accuracy of the sheet position detecting sensor 313 is high, high speed sheet conveyance control is effected to control so that a sheet conveying speed becomes 416 mm/sec (step 14-10).

Then, it is judged whether or not the sheet is an OHP sheet (step 14-3). Regarding the judgement for the OHP sheet, if the output calculation value Px of the sheet surface detecting sensor 312 is $0.6 \leqq Px \leqq 0.7$, it is judged as the OHP sheet, and the threshold correction value of 20 is selected as a fixed value.

If it is judged as the OHP sheet, since the detecting accuracy of the sheet position detecting sensor 313 is low, low speed sheet conveyance control is effected so that a sheet conveying speed becomes 277 mm/sec (step 14-11).

Further, if the output calculation value Px of the sheet surface detecting sensor 312 is $0.3<Px<0.6$, it is judged as an upper limit fixed value area (step 14-5), and the threshold level correction value when the output calculation value Px of the sheet surface detecting sensor 312 is 0.3 (i.e., 50) is used as the fixed value (step 14-6).

If it is judged as this correction fixed value area, since the detecting accuracy of the sheet position detecting sensor 313 is low, low speed sheet conveyance control is effected so that a sheet conveying speed becomes 277 mm/sec (step 14-11).

If the output calculation value Px of the sheet surface detecting sensor 312 is $0<Px<0.08$, it is judged as a lower limit fixed value area (step 14-7), and the threshold corection value when the output calculation value Px of the sheet surface detecting sensor 312 is 0.08 (i.e., 90) is used as the fixed value (step 14-8).

If it is judged as this correction fixed value area, since the detecting accuracy of the sheet position detecting sensor 313 is low, low speed sheet conveyance control is effected so that a sheet conveying speed becomes 277 mm/sec (step 14-11).

Further, if the output calculation value Px of the sheet surface detecting sensor 312 is $0.7<Px$ or $Px \leqq 0$, since the judgement of the kind of sheet is impossible, it is judged as correction error (step 14-9). Further, since the sheet exceeds a design allowable value, a message "sheet judgement error" is displayed on the display 700 of the operating portion 600 (step 14-12).

As mentioned above, in the second embodiment, since the correction control is effected so that the detecting point of the reflection type sensor 313 becomes constant (3.8 mm) regardless of the kind of the sheet, for example, when the predetermined loop amount L1 in the registration is 10 mm, the correction value Lx may be 3.8 mm uniformly.

That is to say, since the sheet detecting point is a location advanced by 3.8 mm from the end (front side of the sensor in the sheet feeding direction) of the sheet position detecting sensor 313, when the predetermined loop amount L1 in the registration is 10 mm, the loop amount after correction becomes 6.2 mm (=10 mm−3.8 mm) by subtracting Lx=3.8 mm from L1=10 mm).

Further, in the above-mentioned first and second embodiments, while the correction control in registration was explained, it should be understood that the present invention can be applied to a sheet sensor in a feeder portion for the sheets or the originals within the image forming apparatus or a sheet sensor for paper handling in a sorter effecting discharge sort after the image transferring to achieve the stable sheet conveyance by effecting correction based on the kind of sheet.

[Third Embodiment]

Figure 14:
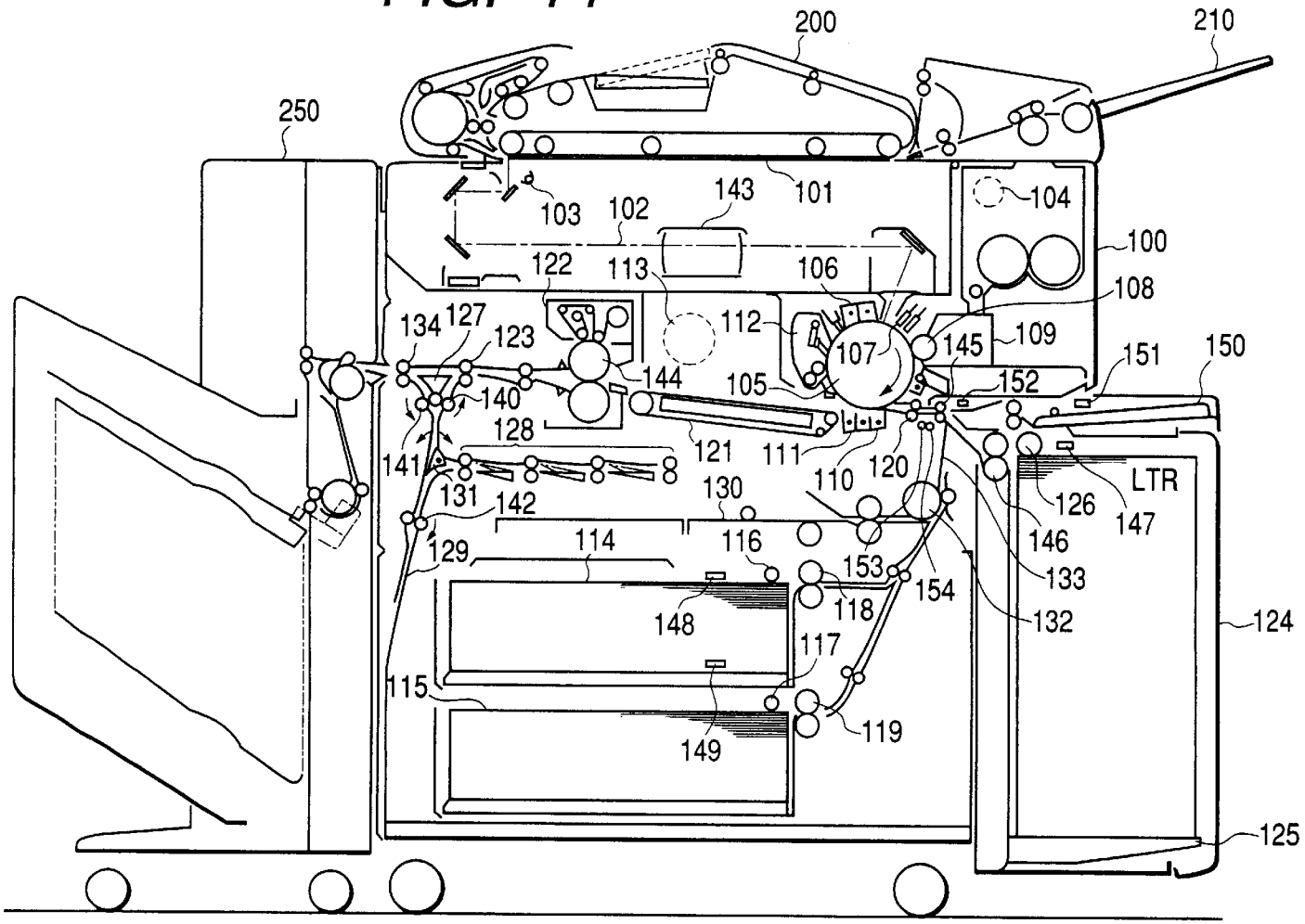
FIG. 14 is a sectional view of an image forming apparatus according to a third embodiment of the present invention.

FIG. 14 is a sectional view of an image forming apparatus according to a third embodiment of the present invention. In FIG. 14, the same elements as those in the first embodiment are designated by the same reference numerals and detailed explanation thereof will be omitted. Here, characteristics of the third embodiment will mainly be described.

In this image forming apparatus, there are provided the following sheet detecting sensors in a sheet conveying path. Such sensors are a deck sheet surface detecting sensor 147, an upper stage sheet surface detecting sensor 148, a lower stage sheet surface detecting sensor 149, a manual feed sheet surface detecting sensor 151 (when discrimination is not necessitated, these sensors will merely be referred to as "sheet surface detecting sensor (147, 148, 149, 151)" hereinafter), a sheet thickness detecting sensor 152, a sheet height detecting sensor 153 and a sheet position detecting sensor 154.

Further, in a conveying path ahead of the registration rollers 120, there is provided a thickness detecting roller 145. A pair of conveying rollers 146 serves to convey the sheet from a paper deck 124.

Figure 15:
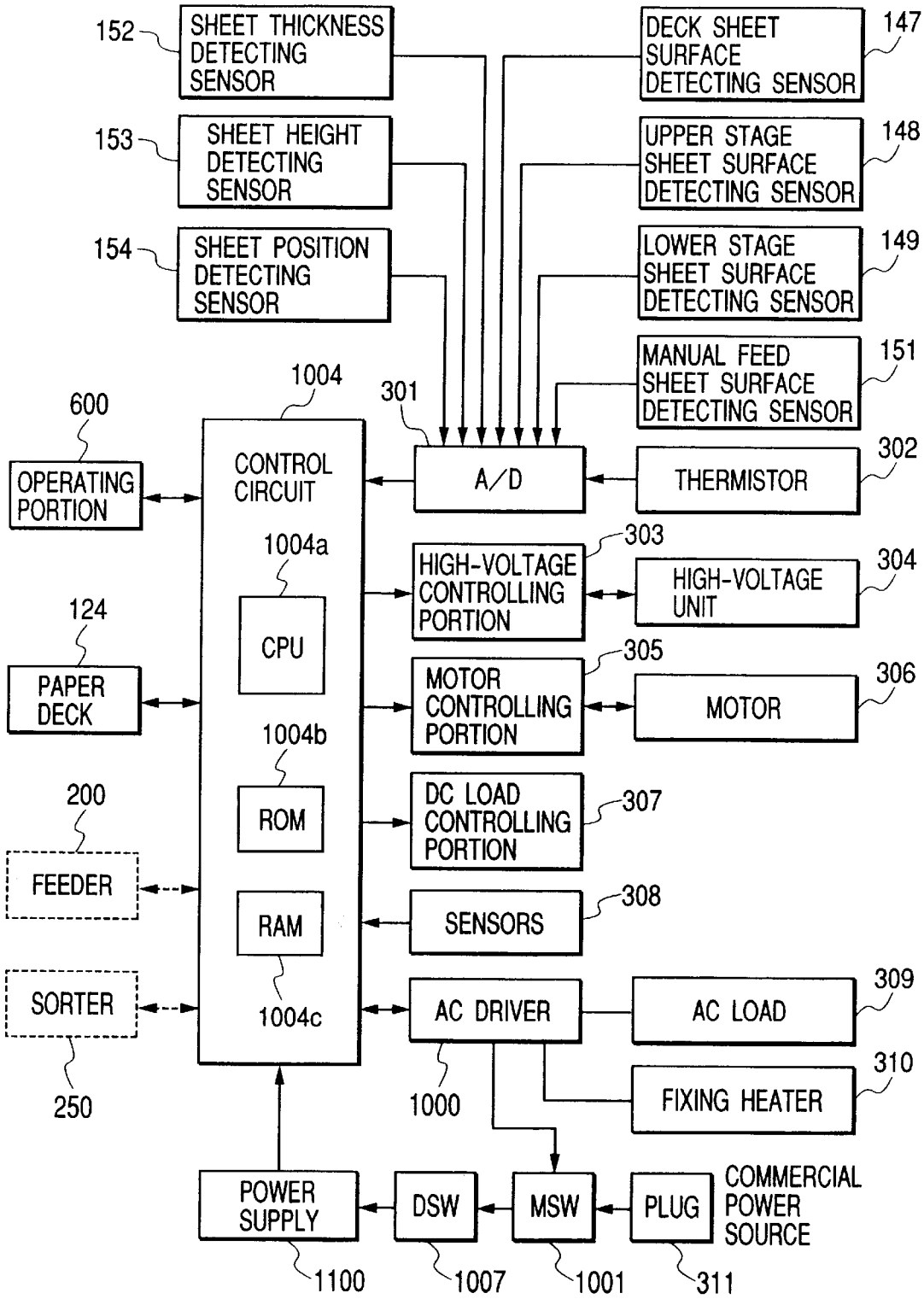
FIG. 15 is a block diagram of a control system of the image forming apparatus according to the third embodiment.

FIG. 15 is a block diagram showing an example of a control system of the image forming apparatus having such sensors. In FIG. 15, a control circuit (controller) 1004 includes a CPU 1004*a*, a ROM 1004*b* and a RAM 1004*c* and serves to control a copying sequence on the basis of program stored in the ROM 1004*b*.

A thermistor 302 serves to detect a surface temperature of a fixing roller 144, and a value A/D-converted by an A/D converter 301 is inputted to the control circuit 1004. The control circuit 1004 effects control on the basis of a detection value of the thermistor 302 so that the surface temperature of the fixing roller 144 becomes a predetermined value.

Further, the deck sheet surface detecting sensor 147, the upper stage sheet surface detecting sensor 148, the lower stage sheet surface detecting sensor 149, the manual feed sheet surface detecting sensor 151, the sheet thickness detecting sensor 152, the sheet height detecting sensor 153 and the sheet position detecting sensor 154 are connected to the A/D converter 301, and input values from these sensors are A/D-converted and are inputted to the control circuit 1004.

A high-voltage controlling portion 303 serves to control charging systems such as a primary charger 106 and a transfer charger 110 and a high-voltage unit 304 for applying predetermined potential to a developing device 109 and the like.

A motor controlling portion 305 serves to control driving of various stepping motors and a motor 306 such as a main drive motor.

A DC load controlling portion 307 serves to control driving of a solenoid for a pick-up roller 116, a clutch for registration rollers 120 and a fan. Sensors 308 such as a sheet jam detecting sensor are connected to the control circuit 1004.

An AC driver 1000 serves to control AC load 309 such as an exposure lamp 103 and AC power supply for a fixing heater 310. Further, it serves to detect abnormality of the exposure lamp 103 and the fixing heater 310 and to turn off a main switch 1001 having a shut-off function.

A power supply 1100 serves to supply DC power source to the control circuit 1004, and commercial power source is inputted from an input power supply plug 311 to the power supply 1100 through the main switch 1001 and a door switch 1007.

A paper deck 124 is a sheet feeding device for increasing the number of stacked sheets, a feeder 200 is an auto original feeder for automatically setting a plurality of originals, and a sorter 250 is a sorting device for sorting discharged sheets.

As described in connection with FIG. 3, an operating portion 600 includes a touch panel 703, an LCD 701 and a back light 702 and is connected to the control circuit 1004.

Figure 16:
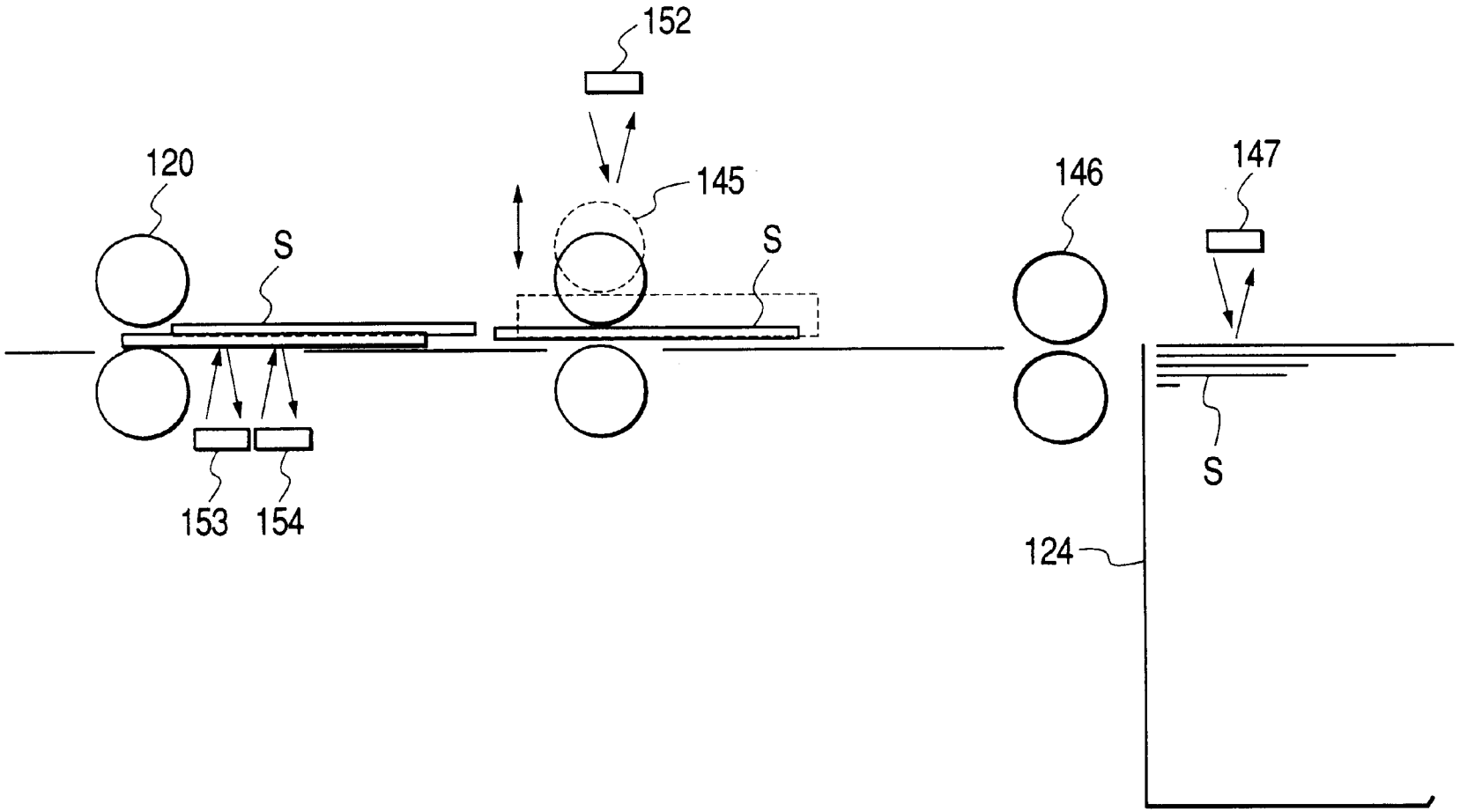
FIG. 16 is a constructural view showing various detecting sensors.

FIG. 16 is a constructural view showing various sheet detecting sensors provided in the sheet conveying path according to the present invention. A sheet S contained in the paper deck 124 is conveyed through the conveying path by a sheet feeding roller 126 and a pair of conveying rollers 146. After the kind of the sheet (plain paper, glossy paper, recycled paper or OHP sheet) is ascertained by the deck sheet surface detecting sensor 147 as will be described later in connection with FIGS. 21A and 21B, the sheet is conveyed to the thickness detecting roller 145, where a thickness of the sheet S is detected by the sheet thickness detecting sensor 152 as will be described later in connection with FIG. 19.

A leading end of the sheet S left the thickness detecting roller 145 is detected by the sheet position detecting sensor 154 as will be described later in connection with FIG. 17, in front of the registration rollers 120. In this case, as will be described later in connection with FIGS. 22A, 22B, 22C and 22D, the detection value of the sheet position detecting sensor 154 is corrected by the sheet height detecting sensor 153 disposed in the vicinity of the sheet position detecting sensor 154.

Similar to the paper deck 124, kinds of sheets contained in a multi manual feed tray 150, an upper stage cassette 114 and a lower stage cassette 115 are detected by the manual feed sheet surface detecting sensor 151, the upper stage sheet surface detecting sensor 148 and the lower stage sheet surface detecting sensor 149, respectively.

Figure 17:
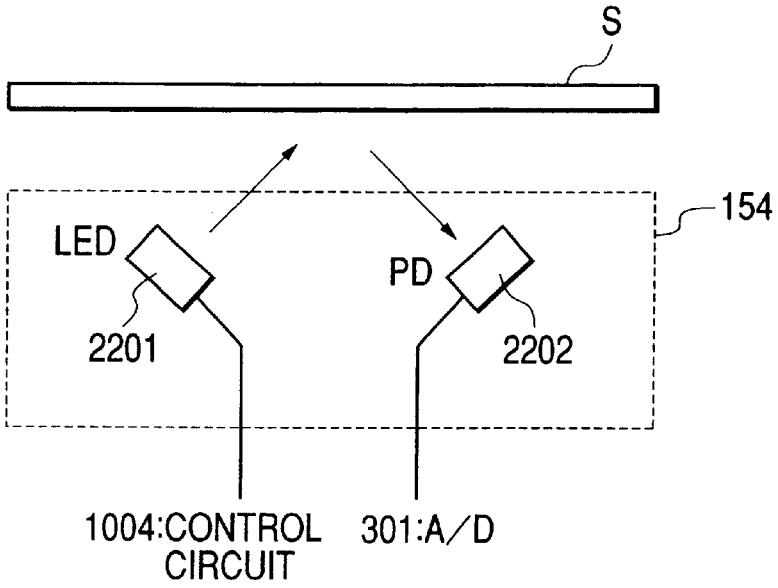
FIG. 17 is a constructural view of a sheet position detecting sensor.
Figure 18:
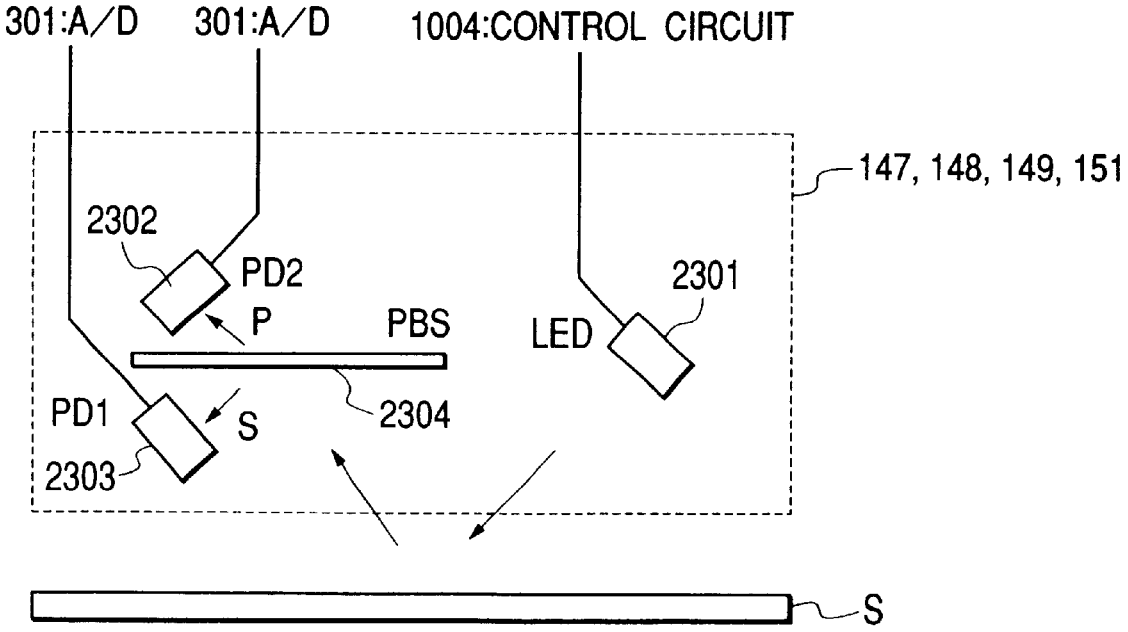
FIG. 18 is a constructural view of a sheet surface detecting sensor.
Figure 19:
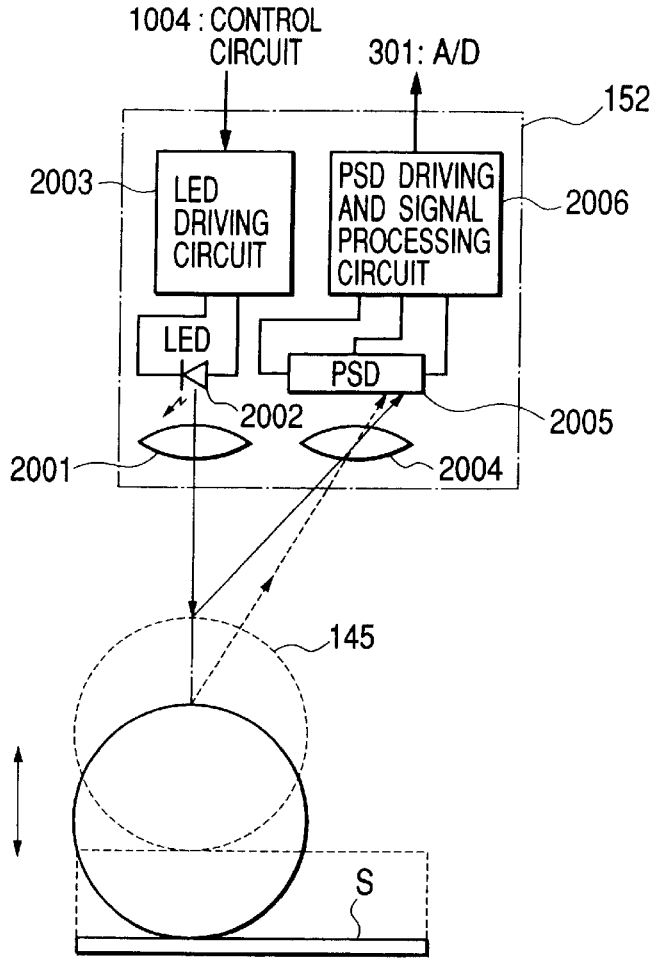
FIG. 19 is a constructural view of a sheet thickness detecting sensor.
Figure 20:
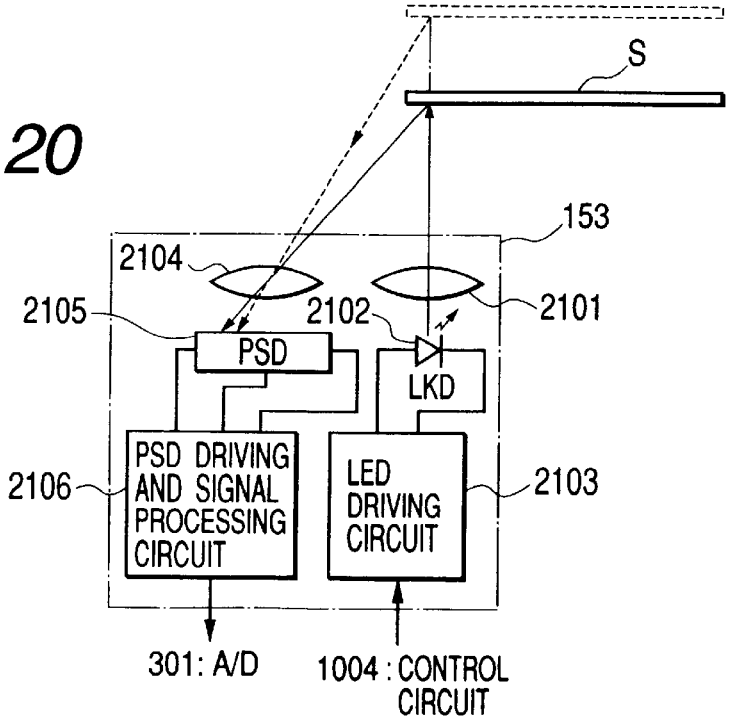
FIG. 20 is a constructural view of a sheet height detecting sensor.

FIGS. 17, 18, 19 and 20 are explanatory views for various sheet detecting sensors according to the present invention. FIG. 17 shows the sheet position detecting sensor 154, FIG. 18 shows the sheet surface detecting sensor 147, 148, 149 and 151, FIG. 19 shows the sheet thickness detecting sensor 152 and FIG. 20 shows the sheet height detecting sensor 153.

In FIG. 17, in the sheet position detecting sensor 154, a light beam emitted from an LED 2201 driven by the control circuit 1004 is reflected by the sheet S on the sheet position detecting sensor 154 and is inputted to a PD (photo-diode) 2202.

The inputted light beam is conveyed into an electric signal by the PD 2202 and is A/D-converted by the A/D converter 301 and is inputted to the CPU 1004*a* of the control circuit 1004.

If there is no sheet S on the sheet position detecting sensor 154, since the light beam is not inputted to the PD 2202, the arrival of the sheet S is detected by the fact that the light beam is inputted to the PD 2202.

Next, the sheet surface detecting sensors 147, 148, 149 and 151 will be explained. In FIG. 18, a light beam emitted from an LED 2301 driven by the control circuit 1004 enters on the sheet S (object to be detected) at a predetermined incident angle.

The incident light beam is reflected by the sheet S and is divided into a P-polarized light component and an S-polarized light component by a PBS (polarizing beam splitter) 2304. The P-polarized light component is inputted to a PD2 (2302) and the S-polarized light component is inputted to a PD1 (2303). The inputted P-polarized light component and S-polarized light component are converted into electric signals by the PD2 (2302) and PD1 (2303), respectively, and are A/D-converted by the A/D converter 301 and are inputted to the CPU 1004*a* of the control circuit 1004.

Due to difference in surface condition of the sheet, reflectances of the P-polarized light component and the S-polarized light component differ from each other. By comparing a ratio between light amounts of the P-polarized light component and the S-polarized light component of the reflected light by utilizing the above fact, a kind of the sheet is judged.

The CPU 1004*a* calculates sum/difference of an A/D-converted value pd2 of the S-polarized light component and an A/D-converted value pd1 of the P-polarized light component as an output calculation value Px of the sheet surface detecting sensor from the following equation:

$$Px(pd2-pd1)/(pd2+pd1)$$

Figure 21A:
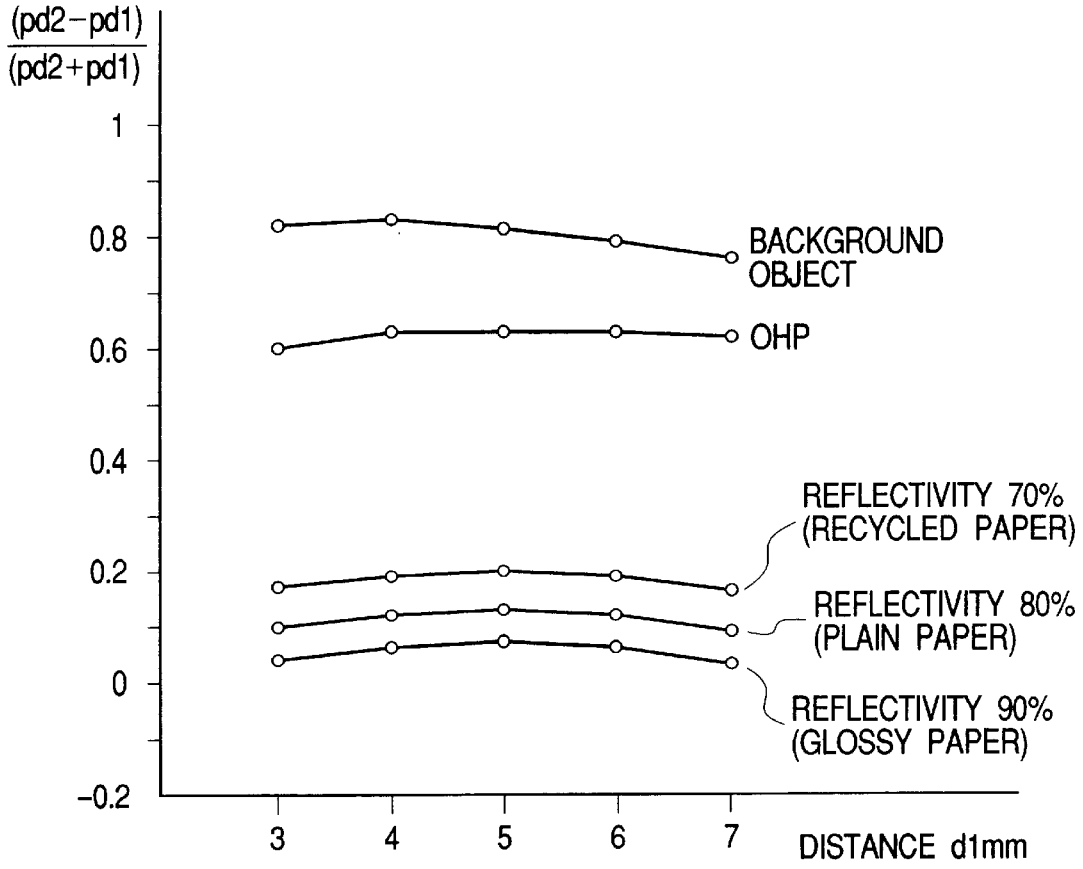
FIGS. 21A and 21B are views showing an output calculation result of the sheet surface detecting sensor.
Figure 21B:
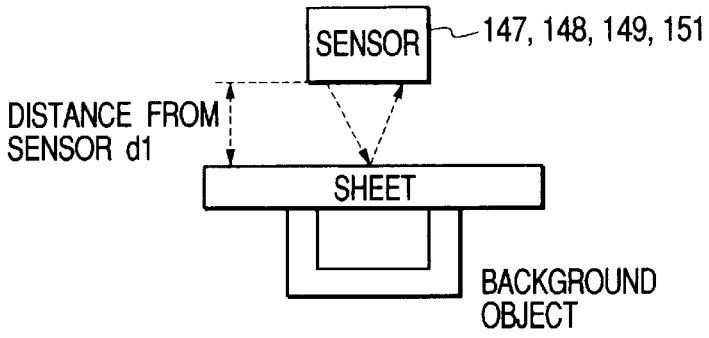

Calculation results from the above equation are shown in FIG. 21A.

In FIG. 21A, the abscissa indicates a distance from the sensor and the ordinate indicates a value calculated on the basis of the above equation. As can be seen from FIG. 21A, when the distance between the sheet (object to be detected) and the sheet surface detecting sensors 147, 148, 149, 151 is 5 mm (central value), the glossy paper (sheet) having reflectance of 90% has a value of 0.06, the plain paper (sheet) having reflectance of 80% has a value of 0.14, the recycled paper (sheet) having reflectance of 70% has a value of 0.22, and the OHP sheet has a value of 0.63.

In the illustrated embodiment, regarding the sheet thickness detecting sensor 152, by using a PSD (semiconductor position detecting element), a thickness of the sheet is detected by detecting a distance between the PSD and the thickness detecting roller 145.

In FIG. 19, the light beam emitted from an LED 2002 driven by an LED driving circuit 2003 in response to a signal from the control circuit 1004 is passed through a lens 2001 and is reflected by the thickness detecting roller 145 and is inputted to a PSD 2005 through a lens 2004.

The light beam inputted to the PSD 2005 is inputted to a PSD driving and signal processing circuit 2006, where a gravity center position of the spot light is calculated and sample-held, and then the light is A/D-converted by the A/D converter 301 and is inputted to the CPU 1004*a* of the control circuit 1004.

Here, when the sheet is a plain paper, the light beam from the LED 2002 is inputted to the PSD 2005 through a path shown by the broken line; however, when the sheet is a thick paper shown by the broken line, the light beam is inputted to the PSD 2005 through a path shown by the solid line. Thus, by difference in gravity center position of the spot light inputted to the PSD 2005, the thickness of the sheet is detected.

In the illustrated embodiment, regarding the sheet height detecting sensor 153, by using a PSD (semiconductor position detecting element), a height of the conveying sheet is detected by detecting a distance between the PSD and the sheet.

In FIG. 20, the light beam emitted from an LED 2102 driven by an LED driving circuit 2103 in response to a signal from the control circuit 1004 is passed through a lens 2101 and is reflected by the sheet and is inputted to a PSD 2105 through a lens 2104.

The light beam inputted to the PSD 2105 is inputted to a PSD driving and signal processing circuit 2106, where a gravity center position of the spot light is calculated and sample-held, and then the light is A/D-converted by the A/D converter 301 and is inputted to the CPU 1004*a* of the control circuit 1004.

Here, normally, the light beam from the LED 2102 is inputted to the PSD 2105 through a path shown by the solid line; however, when the sheet is floating or lifted as shown by the broken line, the light beam is inputted to the PSD 2105 through a path shown by the broken line. Thus, by difference in gravity center position of the spot light inputted to the PSD 2105, the height of the sheet is detected.

FIGS. 22A, 22B, 22C, 22D are explanatory views showing a relationship between the distance from the sheet in the sheet height direction and the output of the sheet position detecting sensor 154. Particularly, FIG. 22A shows a relationship between a distance h in the height direction and the output OP of the sheet position detecting sensor 154, FIG. 22B shows passing times t and the output OP of the sheet position detecting sensor 154 when the sheets are passing through the sheet position detecting sensor 154 at heights h1, h2.

As shown in FIG. 22C, when it is assumed that the timing that the sheets reaches the sheet position detecting sensor 154 corresponds to 01 (output OP of the sheet position detecting sensor 154), at the height h1, the arrival detecting timing becomes t1, and, at the height h2, the arrival detecting timing becomes t2. In this way, the detecting timing is varied with the sheet conveying height.

Thus, the height of the sheet is detected by the sheet height detecting sensor 153 disposed in the vicinity of the sheet position detecting sensor 154, and the timing that the sheet reaches onto the sheet position detecting sensor 154 is corrected.

In the illustrated embodiment, the times t regarding the heights h of the sheet as shown in FIG. 22C are previously stored in the ROM 1004*b* of the control circuit 1004, when the output OP of the sheet position detecting sensor 154 is detected as the predetermined value 01, the CPU 1004*a* reads out the data from the ROM 1004*b*, thereby correcting the timing.

More specifically, for example, when the timing for stopping the sheet at the registration roller 120 portion is selected to T seconds after the sheet was detected by the sheet position detecting sensor 154, if the output h of the sheet height detecting sensor 153 is h1, after (T−t1) seconds are elapsed, the sheet is stopped; whereas, if the output of the sheet height detecting sensor is h2, after (T−t2) seconds are elapsed, the sheet is stopped.

Incidentally, in FIG. 22C, although only two data are shown for explanation, a plurality of data corresponding to the number of detection units required to the heights h and times t can be stored.

Further, as shown in FIG. 22D, the outputs OP of the sheet position detecting sensor 154 with respect to the heights h of the sheet based on the time t1 may be previously stored in the ROM 1004*b* of the control circuit 1004, and the CPU 1004*a* may judge the arrival of the sheet in accordance with the height h of the sheet, when the output OP of the sheet position detecting sensor 154 becomes a predetermined value (for example, output 01 at the height h1, output 02 at the height h2).

Incidentally, similar to FIG. 22C, also in FIG. 22D, although only two data are shown for explanation, a plurality of data corresponding to the number of detection units required to the heights h and times t can be stored.

Further, in place of the fact that the data shown in FIG. 22C or FIG. 22D is stored in the ROM 1004*b*, the graph shown in FIG. 22A or FIG. 22B may be directly calculated by the CPU 1004*a* by using a calculation formula.

Further, in place of the fact that the data shown in FIG. 22C or FIG. 22D is stored in the ROM 1004*b*, the adjusted values may be stored at a factory or a market by using a non-volatile memory which can be re-written.

Figure 23:
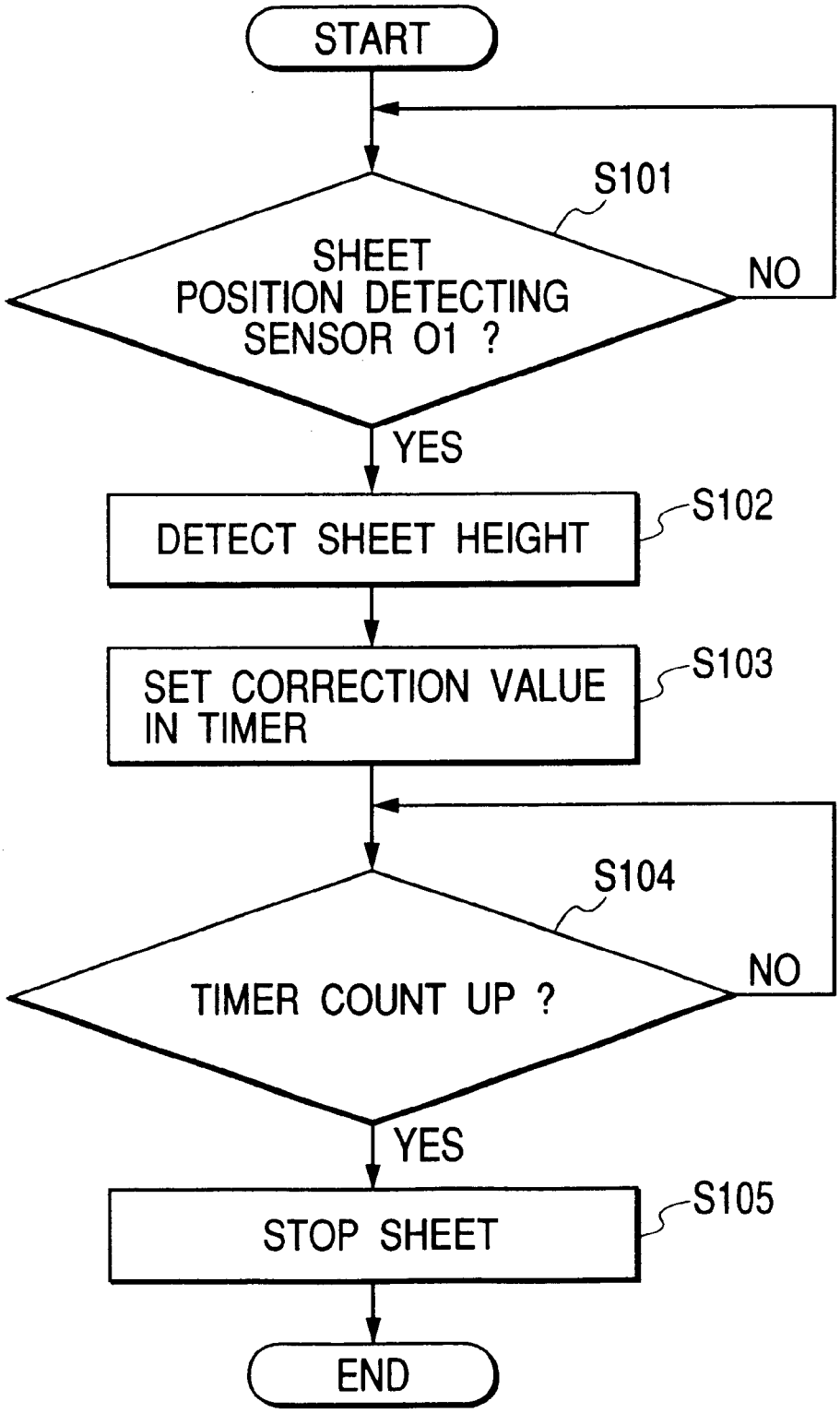
FIG. 23 is a flowchart for sheet stopping control in registration.

FIG. 23 shows an example of a flowchart for control procedure of the control circuit 1004 of the image forming apparatus according to the present invention regarding control in which the sheet is stopped at the registration roller 120 portion.

First of all, when the sequence is started, in a step S101, if the output of the sheet position detecting sensor 154 is judged as the predetermined value 01, it is judged as the arrival of the sheet, and the sheet height detecting sensor 153 is inputted (step S102), and the correction value explained in connection with FIGS. 22A to 22D is set in a timer (step S103), and the timer is started.

When the timer is counted up (step S104), the conveyance of the sheet is stopped (step S105), and the sequence is ended.

(Fourth embodiment)

Figure 24:
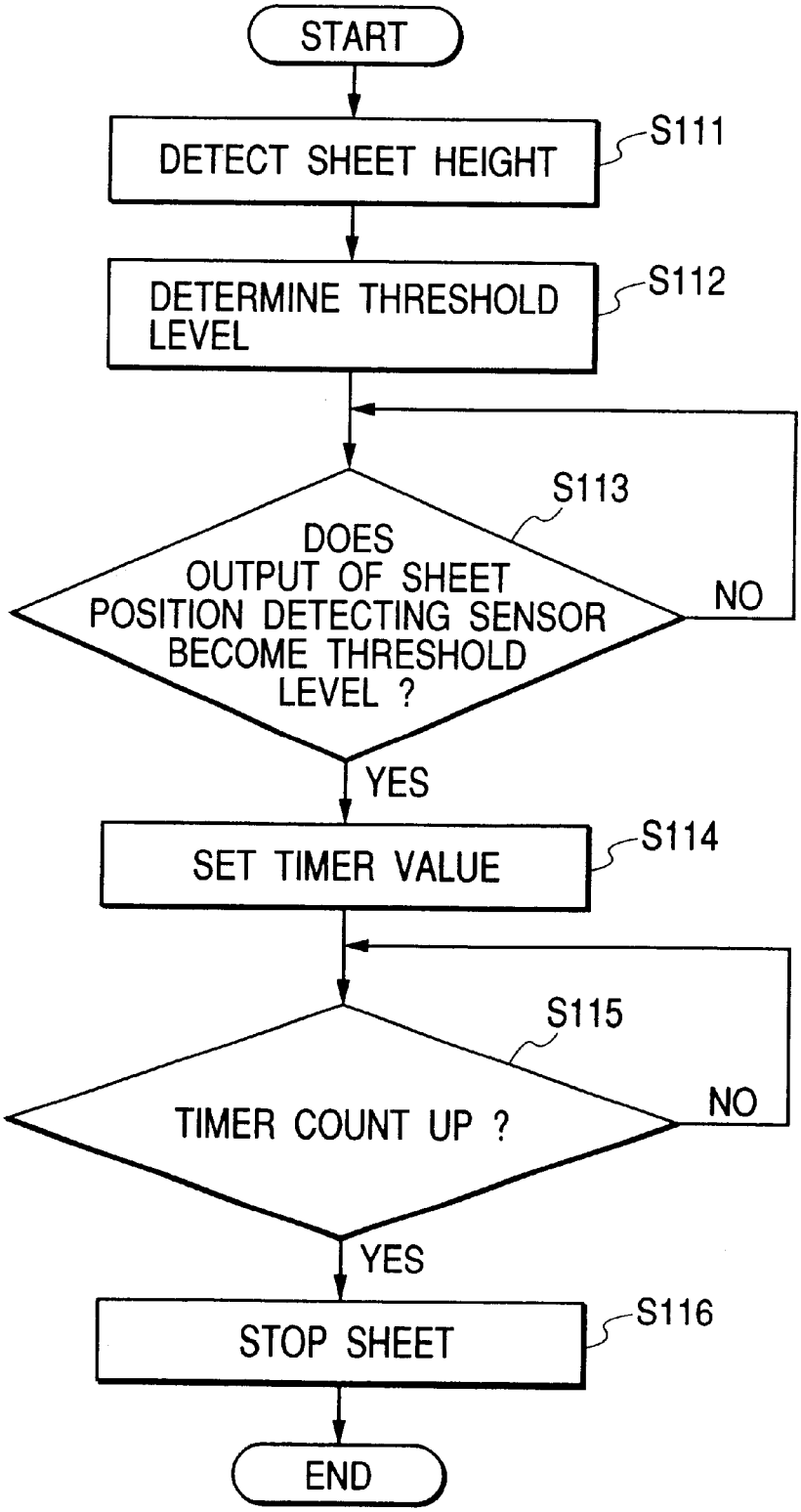
FIG. 24 is a flowchart for sheet stopping control according to a fourth embodiment of the present invention.

FIG. 24 shows a flowchart for control procedure of a control circuit 1004 of an image forming apparatus according to a fourth embodiment of the present invention and shows an example that the threshold level of the output of the sheet position detecting sensor 154 is changed in the control for stopping the sheet at the registration roller 120 portion.

First of all, when the sequence is started, in a step S111, the output of the sheet height detecting sensor 153 is inputted, and the threshold level from which the sheet position detecting sensor 154 explained in connection with FIG. 22 detects the arrival of the sheet is determined (step S112).

Then it is judged whether the output of the sheet position detecting sensor 154 reaches the threshold level determined in the step S112 or not (step S113). If reached, a timer for stopping the sheet is set (step S114), and the timer is started.

When the timer is counted up (step S115), the conveyance of the sheet is stopped (step S115, and the sequence is ended.

(Fifth embodiment)

In a fifth embodiment of the present invention, in an image forming apparatus having the same construction as that in the third embodiment, another control method for controlling a sheet stopping timing will be explained.

FIG. 25 shows correction values for the sheet stopping timing determined on the bases of the outputs of the sheet surface detecting sensors 147, 148, 149, 151 and the output of the sheet thickness detecting sensor 152. In this embodiment, the correction values are previously stored in the ROM 1004*b* of the control circuit 1004.

In this embodiment, the judgement of surfaceness (recycled paper, plain paper, glossy paper or OHP sheet) of the sheet based on the outputs of the sheet surface detecting sensor 147, 148, 149, 151 is effected by the CPU 1004*a* of the control circuit 1004 on the bases of the pre-determined threshold levels.

Further, the judgement of the thickness of the sheet based on the output of the sheet thickness detecting sensor 152 is effected by the CPU 1004*a* of the control circuit 1004 on the bases of the pre-determined threshold levels (for thin paper, plain paper and thick paper).

From the judgement results regarding the surfaceness and thickness, the CPU 1004*a* reads out, for example, data t12 (in case of recycled paper having a normal thickness) or t33 (in case of thick glossy paper) from the ROM 1004*b* and effects control for stopping the sheet being conveyed at timing (t–t12) or (t–t33), where t is a reference value of stopping time.

Incidentally, in the above embodiment, while the control is effected by using the data in which the surfaceness is divided into four and the thickness is divided into three was explained, if necessary, the surfaceness and the thickness may be divided more finely.

Further, the correction value for sheet stopping timing may be common data in all cases where the sheet is stopped in the conveying path or correction data may be given for respective stopping positions.

Particularly, regarding the control in the sheet leading end loop formation in the registration roller 120 portion, data which always give the constant loop amount even when the surfaceness and the thickness of the sheet are changed may be used or data which give optimum loop amount in accordance with the surfaceness and the thickness of the sheet may be used, and, thus, various data can be provided in accordance with the feature of the apparatus.

Further, in place of the fact that the data shown in FIG. 25 is stored in the ROM 1004*b*, the adjusted values may be stored at a factory or a market by using a non-volatile memory which can be re-written.

Figure 26:
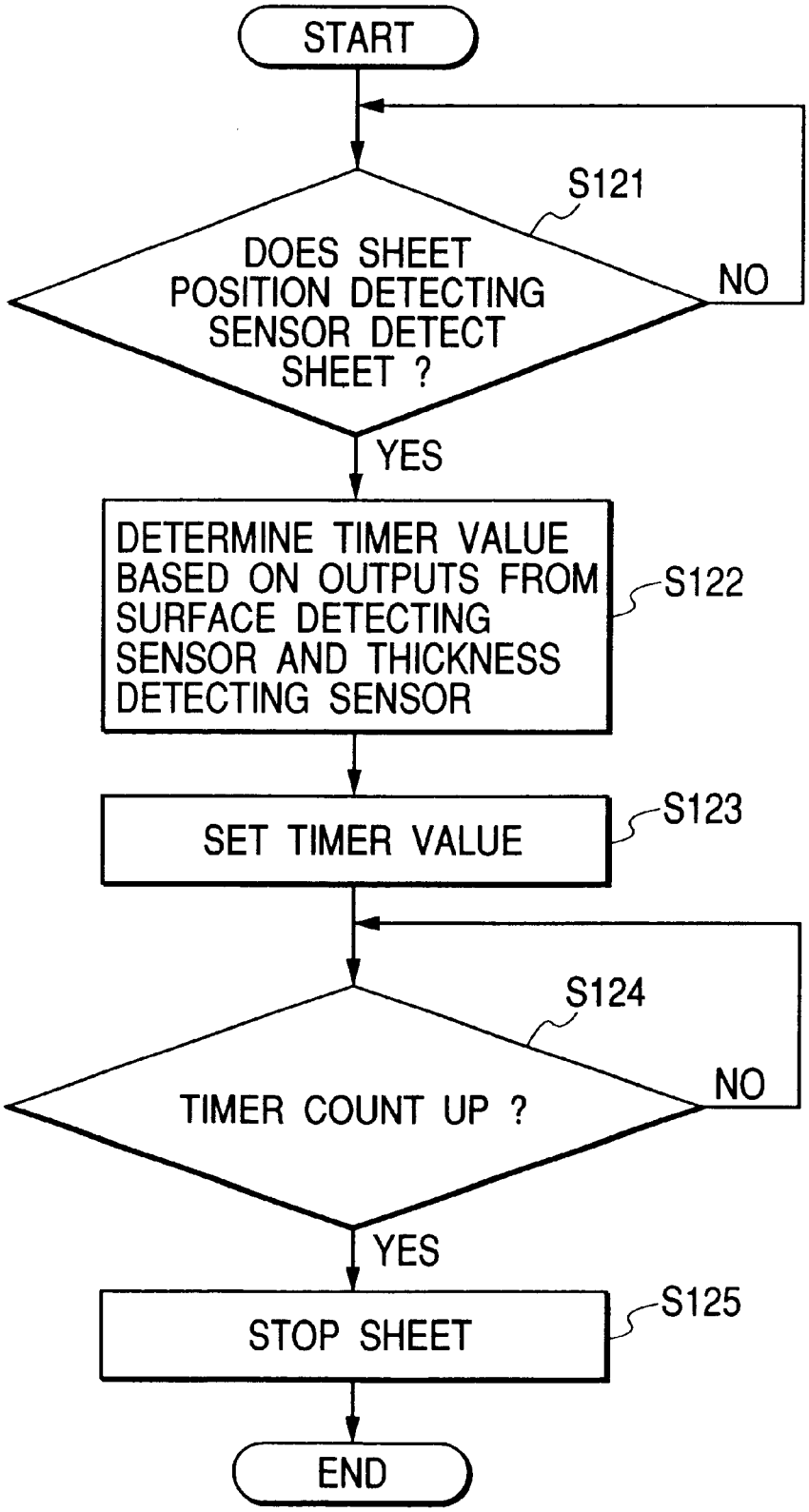
FIG. 26 is a flowchart for setting the sheet stopping timing according to the fifth embodiment.
Figure 27:
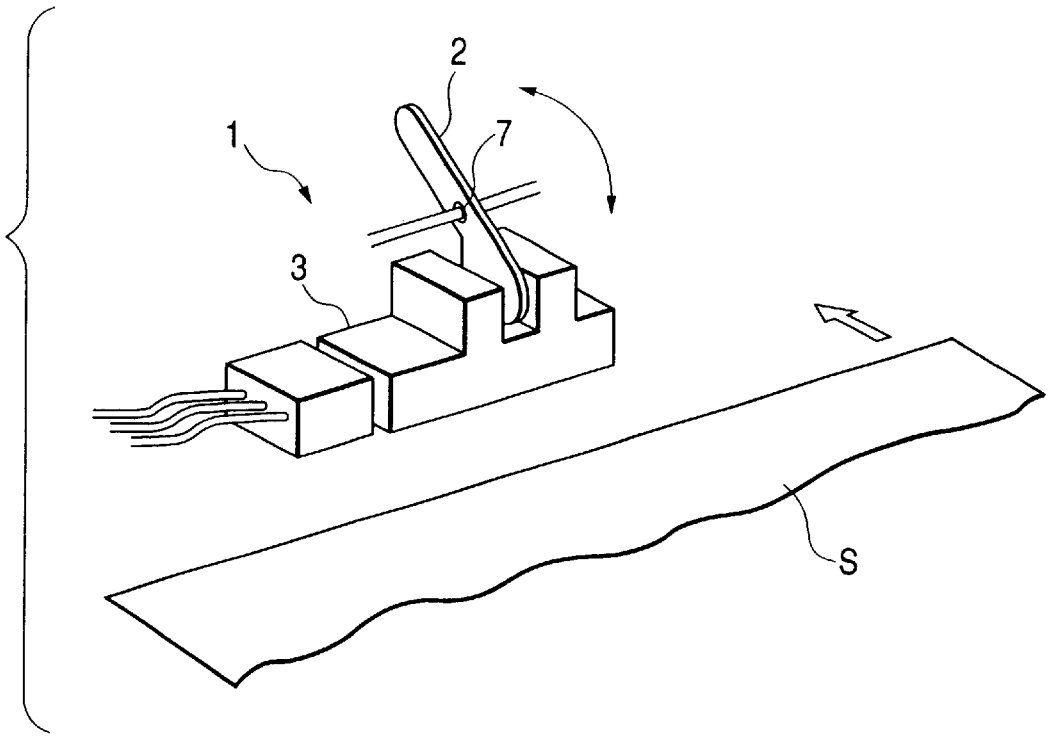
FIG. 27 is a view for explaining a conventional sheet position detecting sensor.
Figure 28:
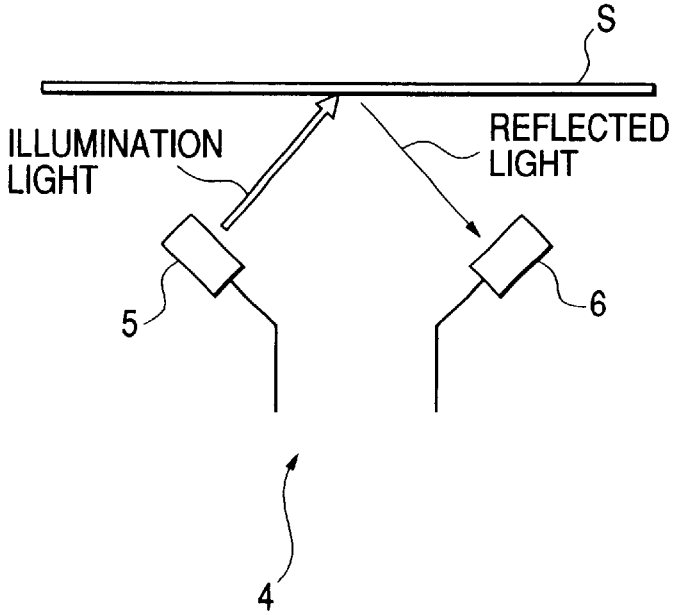
FIG. 28 is a view for explaining a sheet position detecting sensor.
Figure 29A:
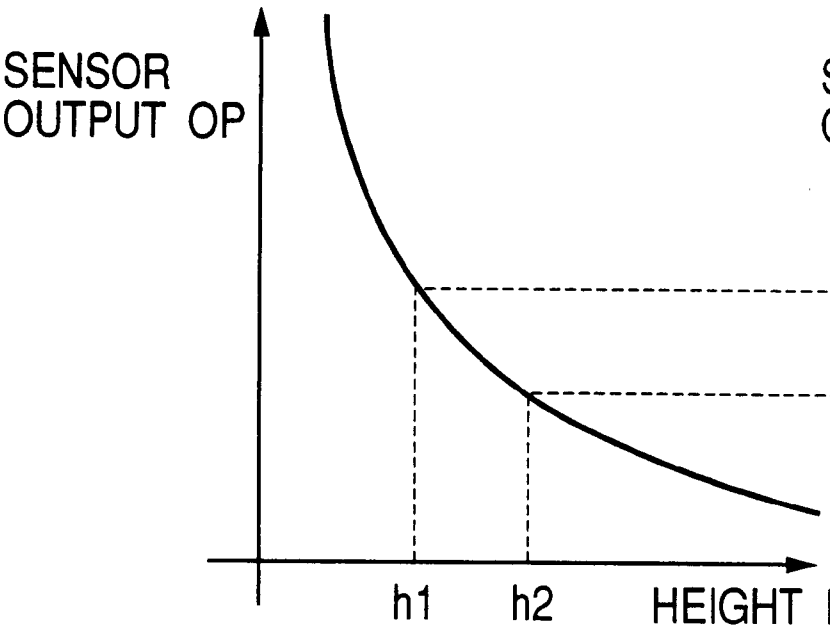
FIGS. 29A and 29B are views for explaining outputs of the sheet position detecting sensor.
Figure 29B:
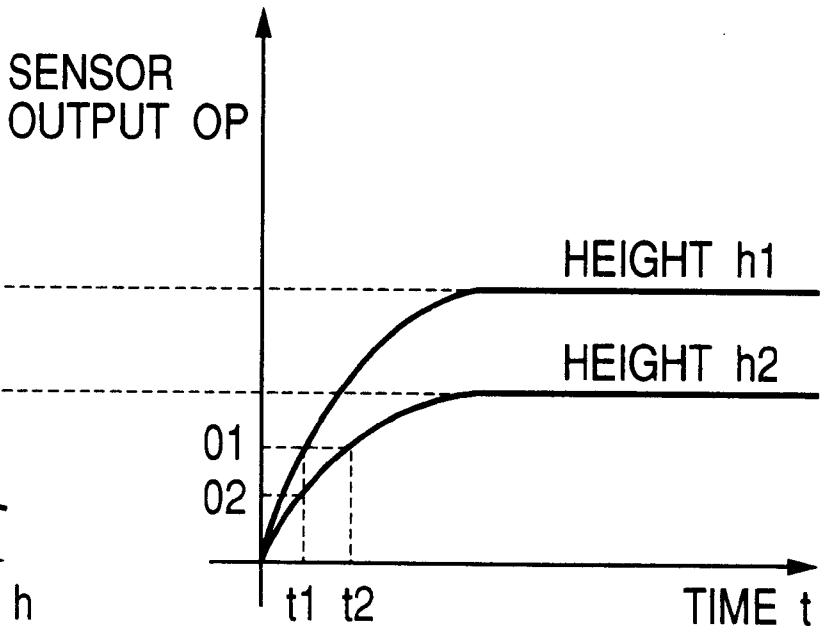

FIG. 26 shows an example of a flowchart for control procedure of the control circuit 1004 of the image forming apparatus according to the present invention regarding control in which the sheet is stopped at the registration roller 120 portion.

First of all, when the sequence is started, in a step S121, it is judged whether the sheet reaches the sheet position detecting sensor 154. If reached, as described in connection with FIG. 25, a correction value txy is determined in accordance with either output of the sheet surface detecting sensor 147, 148, 149 or 151 depending upon the selected and used sheet feeding portion and the output of the sheet thickness detecting sensor 152 (step S122), and (t–txy) is set in the timer with respect to the reference value t (step S123).

Then, it is judged whether the timer is counted up (step S124). If counted up, in a step S125, the sheet is stopped, and the sequence is ended.

As mentioned above, according to the present invention, detection errors due to difference in kind and thickness of the sheet to be detected and difference in conveying height can be reduced, thereby detecting the sheet with high accuracy. The high speed conveyance and small sheet-to-sheet distance control requirements in the sheet conveyance can be satisfied, and the stable sheet conveyance can be achieved.

By judging the fact that the sheet being conveyed is deviated from the allowable range, poor conveyance can be prevented.

The conveyance suitable to the kind and thickness of the sheet can be controlled by the conveyance control means, operator's setting operation and workability for setting the kind of sheet can be improved.

For example, when the loop is formed in the sheet after the sheet is temporarily stopped at the registration portion, the sheet stopping timings of various sheets can be controlled more accurately and more properly, thereby permitting the stable sheet conveyance.

What is claimed is:

1. A sheet detecting apparatus comprising:

sheet position detecting means for detecting that a sheet being conveyed in a conveying path has reached a predetermined position;

sheet surface detecting means for detecting a surface condition of the sheet;

sheet thickness detecting means for detecting a thickness of the sheet; and correction means for correcting a detection result of said sheet position detecting means in accordance with a detection result of the surface condition of the sheet detected by said sheet surface detecting means and the thickness of the sheet detected by said sheet thickness detecting means.

2. A sheet detecting apparatus according to claim 1, wherein said sheet position detecting means comprise a light emitting element for illuminating light onto the sheet being conveyed, and a light receiving element for receiving light reflected from the sheet, and wherein, when an output value of said light receiving element for converting a received light into an electric signal exceeds a predetermined threshold level, a sheet detection signal is emitted, and said correction means correct a sheet detecting timing of said sheet position detecting means.

3. A sheet detecting apparatus according to claim 2, further comprising timer means counted in association with the output of said sheet position detecting means, and wherein said correction means corrects a set value of said timer means.

4. A sheet detecting apparatus according to claim 2, wherein said sheet position detecting means emits a sheet detection signal when the output value of said light receiving element for converting the received light into the electric signal exceeds the predetermined threshold level, and said correction means alters the threshold level.

5. A sheet detecting apparatus according to claim 1, wherein said sheet surface detecting means comprise a light emitting element for illuminating light onto the sheet being conveyed, polarization separation means for separating light reflected from the sheet into two polarized light components, and light receiving elements for receiving the separated two polarized light components respectively, and wherein the surface condition of the sheet is detected based on a calculation value obtained from output values of the two polarized light components.

6. A sheet detecting apparatus according to claim 5, wherein the calculation value is a value obtained by dividing a difference between the two polarized light components by sum of the two polarized light components.

7. A sheet detecting apparatus according to claim 5, further comprising judging means for judging as sheet judgement error if the calculation value is deviated from a predetermined range.

8. A sheet detecting apparatus according to claim 1, wherein said sheet surface detecting means detects reflectance of the sheet with respect to light.

9. A sheet detecting apparatus according to claim 1, wherein said sheet surface decting means is disposed at an upstream side of said sheet position detecting means in the conveying path.

10. A sheet conveying apparatus comprising:

a sheet detecting apparatus as recited in claim 1, and disposed in a conveying sheet is conveyed by conveying means; and conveyance control means for controlling said conveying means based on a corrected detection result of sheet position detecting means.

11. A sheet conveying apparatus according to claim 10, wherein said conveyance control means alters conveyance interval between the sheets conveyed by said conveying means.

12. A sheet conveing apparatus according to claim 10, wherein said conveyance control means alters a sheet conveying speed of said conveying means.

13. A sheet conveying apparatus according to claim 10, wherein said conveyance control means controls to alter a sheet stopping timing when the sheet is stopped by said conveying means.

14. A sheet conveying apparatus according to claim 13, wherein the sheet stopping timing is a sheet stopping operation of said conveying means when a loop is formed in the sheet by abutting a leading end of the sheet against said registration member disposed in the conveying path by said conveying means, or a conveyance starting operation for conveying the sheet from a registration member when a loop is formed in the sheet by abutting a leading end of the sheet against said registration member disposed in the conveying path by said conveying means.

15. A sheet conveying apparatus comprising:

a sheet detecting apparatus as recited in claim 1, and disposed in a conveying path through which a sheet is conveyed by conveying means;

wherein a sheet stopping timing associated with a sheet stopping operation of said conveying means when a loop is formed in the sheet by abutting a leading end of the sheet against said registration member disposed in the conveying path by said conveying means, or a conveyance starting operation for conveying the sheet from a registration member when a loop is formed in the sheet by abutting a leading end of the sheet against said registration member disposed in the conveying path by said conveying means is altered based on a corrected detection result of said sheet position detecting means, kind and thickness of the sheet detected by said sheet surface detecting means, and said sheet thickness detecting means and loop forming amount control information corresponding to pre-set kind and thickness of the sheet.

16. A sheet conveying apparatus according to claim 15, wherein the sheet stopping timing is altered so that a loop forming amount becomes constant.

17. A sheet conveying apparatus according to claim 15, wherein the sheet stopping timing associated with the sheet stopping operation of said conveying means or the conveyance starting operation for conveying the sheet from said registration member is altered so that the loop forming amount control information corresponding to the pre-set kind and thickness of the sheet becomes a loop forming amount corresponding to the sheet having different kind and thickness.

18. An image forming apparatus comprising:

a sheet conveying apparatus as recited in claim 10; and image forming means for forming an image on a sheet conveyed by said sheet conveying apparatus.

* * * * *

UNITED STATES PATENT AND TRADEMARK OFFICE

CERTIFICATE OF CORRECTION

PATENT NO. : 6,385,406 B1
DATED : May 7, 2002
INVENTOR(S) : Yoshihiro Funamizu et al.

It is certified that error appears in the above-identified patent and that said Letters Patent is hereby corrected as shown below:

Column 1,
Line 26, “arise” should read -- raise --.
Line 28, “arise” should read -- raise --.
Line 38, “exists,” should read -- exist, --.

Column 2,
Line 18, “arise” should read -- raise --.

Column 13,
Line 44, “corection” should read -- correction --.

Column 20,
Line 62, “sheet” should read -- path through which a sheet --.

Column 21,
Line 5, “conveing” should read -- conveying --.

Signed and Sealed this

Second Day of July, 2002

*Attest:*

*Attesting Officer*

JAMES E. ROGAN
*Director of the United States Patent and Trademark Office*